US005488352A

United States Patent [19]

Jasper

[11] Patent Number: 5,488,352

[45] Date of Patent: Jan. 30, 1996

[54] COMMUNICATIONS AND CONTROL SYSTEM FOR TRACTOR/TRAILER AND ASSOCIATED METHOD

[75] Inventor: Kenneth O. Jasper, Charlotte, N.C.

[73] Assignee: Vehicle Enhancement Systems, Inc., Rockhill, S.C.

[21] Appl. No.: 147,043

[22] Filed: Nov. 1, 1993

Related U.S. Application Data

[63] Continuation-in-part of Ser. No. 899,617, Jun. 16, 1992, abandoned.

[51] Int. Cl.[6] ..... G08B 21/00

[52] U.S. Cl. ..... 340/431; 340/431; 280/423.1

[58] Field of Search ..... 440/431, 825.06; 191/11; 280/420, 422, 423.1; 439/38–39; 364/900, 424, 424.07

[56] References Cited

U.S. PATENT DOCUMENTS

| | | | |
|---|---|---|---|
| 2,379,664 | 7/1945 | Stanko | 236/790 |
| 2,483,815 | 10/1949 | Easton | 236/790 |
| 3,154,360 | 10/1964 | Plishner | 439/335 |
| 3,184,703 | 5/1965 | Piscitello et al. | 439/335 |
| 3,387,606 | 6/1968 | Crafts et al. | 138/202.27 |
| 4,041,470 | 8/1977 | Slane et al. | 364/900 |
| 4,624,472 | 11/1986 | Stuart et al. | 280/420 |
| 4,715,012 | 12/1987 | Mueller, Jr. | 364/900 |
| 4,735,461 | 4/1988 | Moller et al. | 303/7 |
| 4,752,899 | 6/1988 | Newman et al. | 364/424 |
| 4,767,181 | 8/1988 | McEowen | 387/78 |
| 4,772,209 | 9/1988 | Muncey | 439/36 |
| 4,838,797 | 6/1989 | Dodier | 439/38 |
| 4,839,531 | 6/1989 | Stemmons et al. | 307/17 |
| 4,897,642 | 1/1990 | DiLullo et al. | 340/825.06 |
| 4,969,839 | 11/1990 | Nilsson | 439/395 |
| 5,025,253 | 6/1991 | DiLullo et al. | 340/825.06 |
| 5,142,278 | 8/1992 | Moallemi et al. | 340/825.06 |

OTHER PUBLICATIONS

Serial Data Communications Between Microcomputer Systems in Heavy Duty Vehicle Applications—SAE J1708 Jun. 1987.

*Primary Examiner*—John K. Peng
*Assistant Examiner*—Ashok Mannava
*Attorney, Agent, or Firm*—Bell, Seltzer, Park & Gibson

[57] ABSTRACT

A communications channel interconnects first and second controllers positioned in the tractor and trailer, respectively, and includes inductive coupling coils carried by an electrical connector so that the connector is preferably compatible with the industry standard J560 connector. The communications channel also preferably includes first and second sections of twisted pair cable extending between respective controllers and coils. The connector includes disengageable first and second connector portions to facilitate disconnecting the tractor and the trailer. A pair of controllers communicates over the communications channel via respective modems. In addition, each of the controllers includes digital and analog interfaces for receiving and outputting signals to monitor and control operation of various subsystems of the tractor/trailer combination.

60 Claims, 19 Drawing Sheets

COMMUNICATIONS AND CONTROL SYSTEM FOR TRACTOR/TRAILER AND ASSOCIATED METHOD

RELATED APPLICATION

This is a continuation-in-part application of an application entitled "Magnetic Circuits for Multiplexing Data", filed Jun. 16, 1992, and having Ser. No. 07/899,617, now abandoned the entire disclosure of which is incorporated herein by reference.

FIELD OF THE INVENTION

This invention relates generally to data communication. More specifically, this invention relates to a system and associated method for data communication and control between a tractor and a trailer.

BACKGROUND OF THE INVENTION

The trucking industry has for many years used tractor/trailer combinations to transport cargo over the roadways to intended destinations. The tractors and the trailers are mechanically coupled together so that the tractor can pull the trailer with its cargo in an efficient and cost effective manner.

Various links between the tractor and the trailer provide vehicle subsystems with power and/or control signals to operate. Thus, hydraulic, pneumatic, electrical and other subsystems on the tractor/trailer combination have associated electrical conductors and pneumatic lines running therebetween so these subsystems can operate.

With regard to electrical subsystems, both the tractor and trailer operate in a manner which requires coordination between the electrical components on each to operate the tractor/trailer combination safely and effectively. In order to coordinate such operation and further to supply power from the tractor to the trailer, a seven-pin connector has been used by the trucking industry to accomplish these and other electrical objectives. The connector includes two disengageable connector portions to permit the tractor and trailer combination to be disconnected. An example of such a seven-pin connector is illustrated in U.S. Pat. No. 4,969,839 to Nilsson, the entire disclosure of which is specifically incorporated herein by reference. These seven-pin connectors are well known and have been specified by the Society of Automotive Engineering (SAE) according to the standard number "SAE J560" the teachings of which are also incorporated herein by reference. Thus, one need only ask for an SAE J560 connector from an appropriate manufacturer and the standard seven-pin connector will be delivered.

Each of the pins in the standard seven-pin connector is an electrical conductor carried by the plug portion of the connector and which is adapted to mate with a corresponding electrical contact in the receptacle portion of the connector to thereby bus an electrical signal between the tractor and the trailer. The signals generally relate to specific electrical subsystems, for example, ground, turn signals, brake lights, clearance lamps, flashers, and other devices which require electrical power to function. The seventh pin on the connector is usually an "auxiliary" pin which can be used for specific electrical purposes or applications on individual tractor/trailer combinations.

The trucking industry has not until very recently incorporated sophisticated electrical and electronic subsystems in tractor/trailer combinations which perform varied tasks that usually involve data manipulation and transmission. Computers, controllers, and computer-type electrical systems have simply not found their way into the tractor/trailer combination in any significant fashion up to now due, in part, to the low level of technological innovation in the trucking industry and further due to a lack of governmental or other authoritative impetus which would otherwise require systems to be installed on tractor/trailers that include sophisticated electronics and data communications.

However, with the advent of new anti-lock braking subsystems (ABS) for example, and other new subsystems which promote tractor/trailer safety and enhanced performance, microprocessors have found their way into use in the trucking industry, and specifically in applications involving tractor/trailer combinations to enhance the performance of these new subsystems. It is apparent that the use of computers and microprocessors in general in the trucking industry will continue to expand and provide ever increasing capabilities to tractor/trailer combinations in a wide range of applications.

Along with the sophistication of computer and electronic subsystems comes the requirement of equally sophisticated and versatile data communications between microprocessors and devices which use data output from the computers, or which input data to the computers. Thus, it is desirable to develop and implement data communication links and circuits to provide the microprocessors and systems in tractor/trailer combinations with reliable data communication. This is particularly true when data must be communicated between data producing devices and data receiving devices that may be found both on the tractor and the trailer, and when data must be transmitted between the tractor and the trailer. An example of this type of data communication between the tractor and the trailer is found in an ABS subsystem where data about the performance of the brakes on the trailer is desirably communicated to a computer in the tractor which will, in turn, further actuate control valves on the trailer to control the ABS's performance.

Unfortunately, the standard seven-pin connector, ubiquitous in the trucking industry, is simply not suited to provide sophisticated data communications between the tractor and the trailer. The seven-pin connector has only been used in the past to provide analog electrical signals, particularly power, to low-level, unsophisticated electrical subsystems in the tractor/trailer combination. Yet, the J560 seven-pin connector is an industry standard which is used in virtually every tractor/trailer in service today and so is likely to remain in service for many years. In addition, the same J560 connector is used and thus similarly hampers agricultural applications in the operation of implements towed by farm tractors. Also, the International Standards Organization (ISO) sets standards for international markets, such as in Europe and Japan, and one of their connector standards is nearly identical to those of the SAE J560.

SUMMARY OF THE INVENTION

In view of the foregoing background, it is therefore an object of the present invention to provide a communications and control system and associated method for a tractor/trailer combination to support data communications between the tractor and the trailer.

It is another object of the invention to provide a communications and control system and associated method for a tractor/trailer combination that is rugged and reliable, and is also compatible with the standard J560 seven-pin connector widely used in the trucking and agricultural industries.

These and other objects, features and advantages of the present invention are provided in a tractor/trailer combination by a communications channel interconnecting first and second controllers positioned in the tractor and trailer, respectively, and wherein the communications channel uses inductive coupling across an electrical connector so that the connector is preferably compatible with the industry standard J560 connector. The communications channel also preferably includes first and second sections of twisted pair cable extending between respective controllers and the coils which provide the inductive coupling.

In other words, the vehicle includes a plurality of electrical conductors extending between the tractor and the trailer, and a connector electrically connected in series with the electrical conductors. As used herein, the term "trailer" will be understood to also include farm implements which are towed by a farm tractor.

The connector includes disengageable first and second connector portions to facilitate disconnecting the tractor and the trailer. Inductive coupling means is carried by the connector for inductively coupling thereacross. The inductive coupling means comprises first and second portions, preferably first and second coils, inductively coupled together and carried by respective disengageable first and second connector portions.

The connector preferably has a generally cylindrical shape. Accordingly, the first and second coils are preferably positioned on respective first and second disengageable connector portions so as to be generally coaxially oriented. This arrangement provides very good signal coupling efficiency.

The trailer includes first signal generating means for generating a first signal relating to operation of the vehicle. For example, the signal generating means may be a transducer, sensor, contact status, or other quantity related to operation of the vehicle. The trailer controller includes modulation means cooperating with signal generating means for modulating the generated signal for transmission across the first coil. The tractor controller includes demodulation means connected to the second coil for demodulating the signal from the modulation means. In a preferred embodiment, the communication between the two controllers is bidirectional, and, accordingly, each controller includes a modulator/demodulator (MODEM). The MODEMS preferably operate using frequency shift keying (FSK) to thereby readily facilitate a multidrop architecture and higher data transmission rates. One skilled in the art would, of course, recognize that spread spectrum modulation would also provide many of the same advantages as FSK techniques.

A display is preferably positioned within the tractor or in the mirrors mounted outside the tractor and is driven by the tractor controller for displaying information related to the vehicle. The display may be in the form of indicator lights, gauges, a CRT screen, and the like, as would be readily understood by those skilled in the art. Thus, the driver is informed of the operating condition of various vehicle subsystems. For example, the signal generating means carried by the trailer may be a trailer temperature, a trailer location transponder, a trailer smoke detector status, a trailer identification number, a trailer tire pressure, a trailer brake temperature, a trailer axle temperature, or a trailer light status.

To interface with a plurality of signal generating means, the trailer controller preferably also includes a multiplexor for multiplexing the plurality of signals for transmission over the communications channel to the tractor controller. As would be readily understood by those skilled in the art, both controllers may also include multiplexor/demultiplexors or MODEMs.

As would also be readily appreciated by those skilled in the art, each of the controllers may also preferably include digital interface means for interfacing with a digital input signal relating to operation of the vehicle, and/or a digital output signal for operation the vehicle. In addition, each controller may also include analog interface means for interfacing with an analog input signal relating to operation of the vehicle and/or an analog output signal for operation the vehicle. Each controller may also further include memory means or a recorder adapted for storing data related to operation of the tractor and the trailer. Each controller may also include data bus interface means for communicating with a plurality of data transceivers carried by the vehicle. For example, the data bus format and transceivers may be of the type as specified in SAE Recommended Practice J1708 entitled *Serial Data Communications Between Microcomputer Systems in Heavy Duty Vehicle Applications* (June 1987), the entire disclosure of which is hereby incorporated herein by reference. In addition, the controllers may also be capable of supporting higher speed data communications in full compliance with the proposed SAE J1939 data bus standard.

A method aspect of the present invention relates to a method for communicating between first and second controllers carried by the tractor and trailer, respectively—the tractor and trailer being of the type including a plurality of electrical conductors extending therebetween and a connector electrically connected in series with the plurality of electrical conductors. As discussed above, the connector preferably includes disengageable first and second connector portions compatible with the J560 connector to facilitate disconnecting the tractor and trailer. Accordingly, the method includes the steps of: positioning first and second coils on the respective first and second connector portions so that the first and second coils are in inductively coupled relation; connecting the respective first and second coils to the first and second controllers respectively; and transmitting a signal from the first controller to the second controller via inductive coupling between the first and second coils.

The first and second connector portions are generally cylindrical. Accordingly, the step of positioning the first and second coils preferably includes positioning the coils on the first and second connector portions so as to be generally coaxially oriented relative to one another. In addition, the step of connecting the first and second controllers to the first and second coils preferably includes connecting the coils via respective twisted pair cables. The step of transmitting preferably includes modulating a signal at the first controller and demodulating the modulated signal at the second controller for inductive coupling across the connector. FSK or spread spectrum are the preferred modulation schemes.

The communications system described herein promotes the use of more complex computer driven circuitry in tractor/trailer combinations, thereby allowing new tractor/trailer combinations to be more sophisticated and versatile. Moreover, because the communications system is compatible with the existing J560 connector, retrofit of existing vehicles is also possible according to the present invention. One advantage of such a retrofit is that it may be carried out gradually throughout a fleet without incurring any incompatibility between fitted and unfitted tractors and trailers.

DETAILED DESCRIPTION OF PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
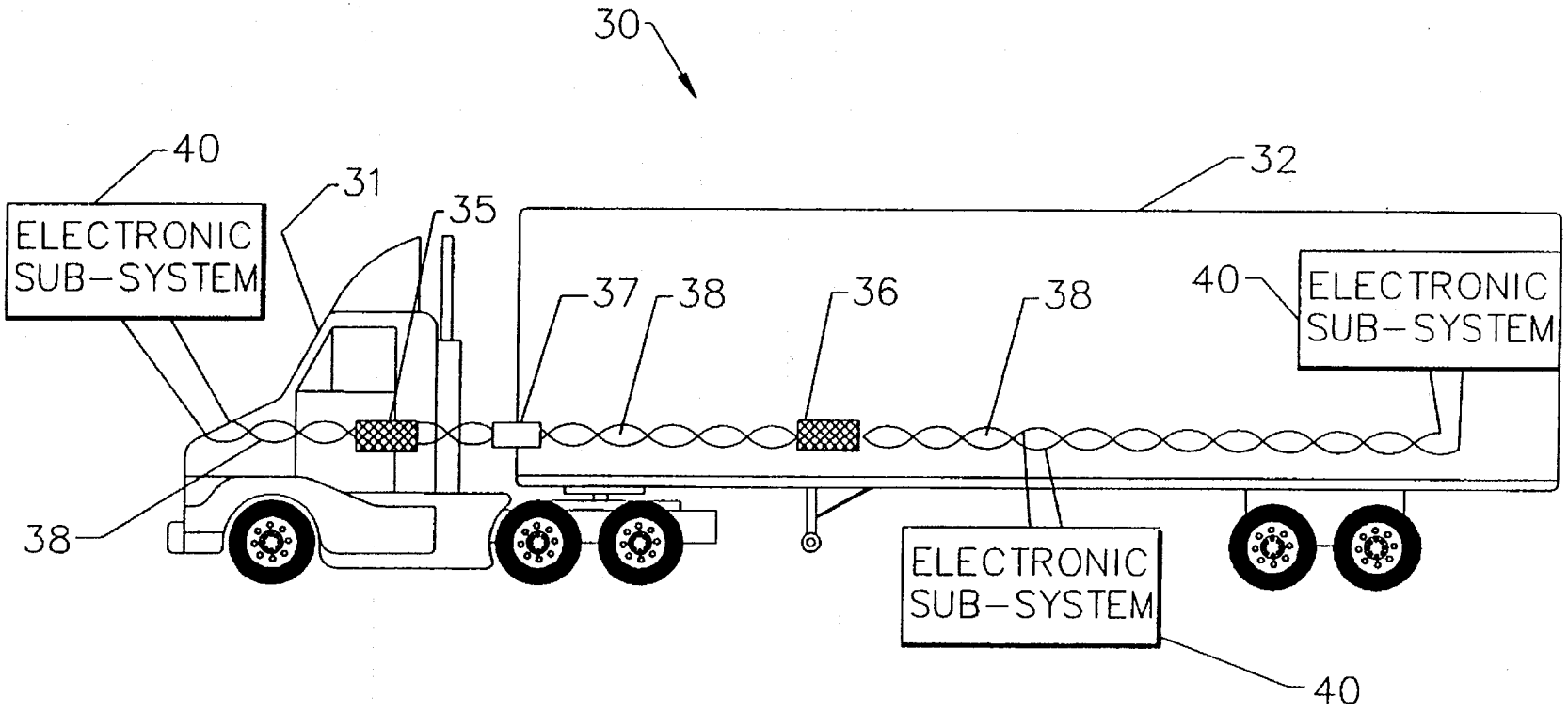
FIG. 1 is a schematic diagram of a tractor/trailer combination including a communications system according to the present invention.

Referring now to the FIG. 1, a tractor/trailer vehicle combination 30 is illustrated including the communications and control system of the present invention. The tractor/trailer combination 30 includes a tractor 31 connected to a trailer 32 for pulling the trailer. As would be readily understood by those skilled in the art, the tractor 31 and trailer 32 include respective frames, and means for coupling the tractor and trailer together, not shown. In addition, the tractor 31 includes an engine, such as a diesel engine, or other motor means for moving the tractor 31 to thereby pull the trailer 32.

A first controller 35 is carried by the tractor, and a second controller 36 is carried by the trailer. The controllers 35, 36 communicate via a communications channel provided via inductive coupling means associated with a connector 37 compatible with a J560 connector, as described in greater detail below. The controllers 35, 36 permit the implementation of sophisticated control and monitoring between the tractor 31 and the trailer 32. Twisted pair cable 38 is used to connect the controllers to the inductive coupling coils carried by the connector 37.

In general, an electronic subsystem 40 or data-producing or other signal generating means is found in the trailer 32. Similarly, an electronic subsystem 40 may also be found in the tractor 31. These electronic subsystems can be connected to a respective controller 35, 36 via twisted pair cable 38, as shown in the schematic diagram of FIG. 1.

The communications channel of the present invention is preferably interfaced with at least one J560 seven-pin compatible connector which serves in the present embodiment to electrically link all the previous electrical power needs which have heretofore been necessary in a tractor/trailer combination 30. Accordingly, it will be useful in understanding the present invention to first understand the prior art J560 seven-pin connector as it has been used previously in the trucking industry.

Figure 2:
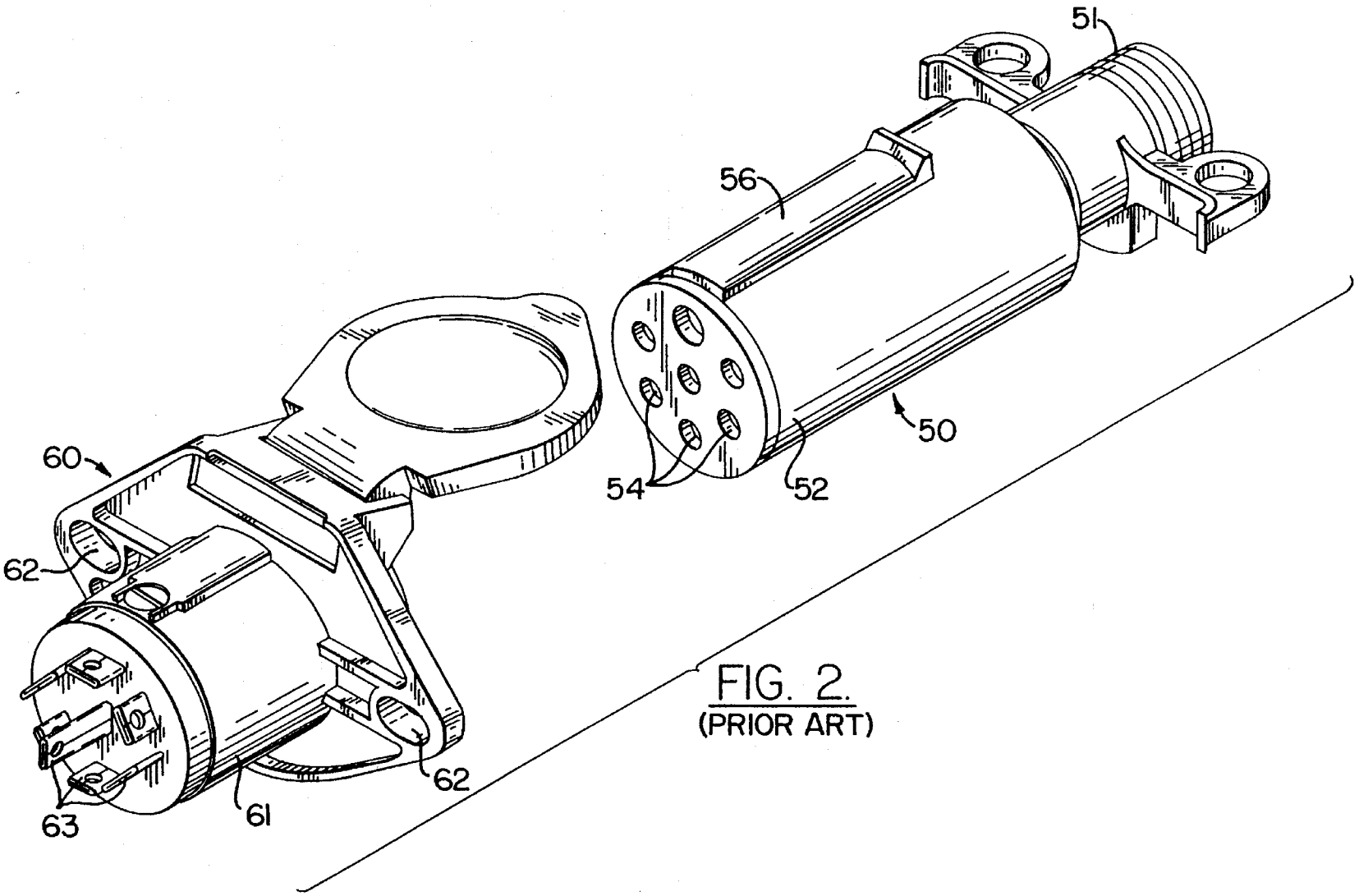
FIG. 2. (PRIOR ART)
FIG. 2 is an isometric exploded view of a prior art SAE J560 connector.
Figure 3B:
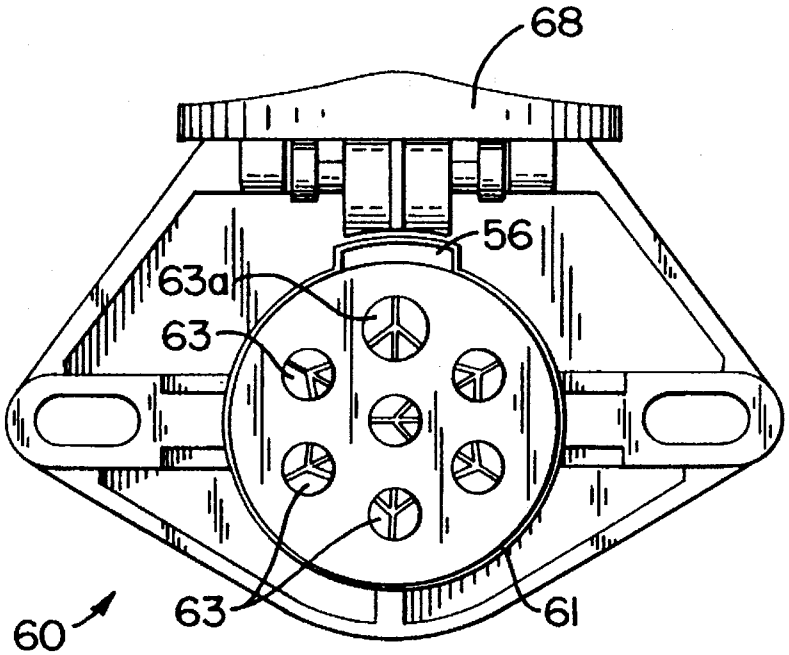
FIG. 3B. (PRIOR ART)
FIGS. 3A and 3B are elevational views of the two pieces of the prior art J560 connector of FIG. 2.
Figure 3A:
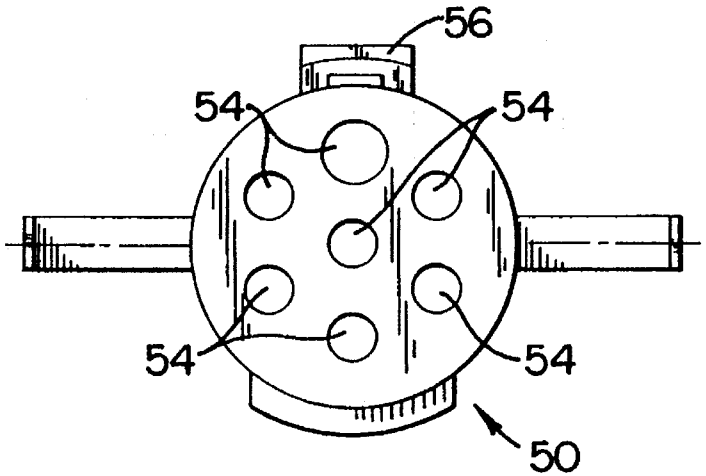
FIG. 3A. (PRIOR ART)
Figure 4:
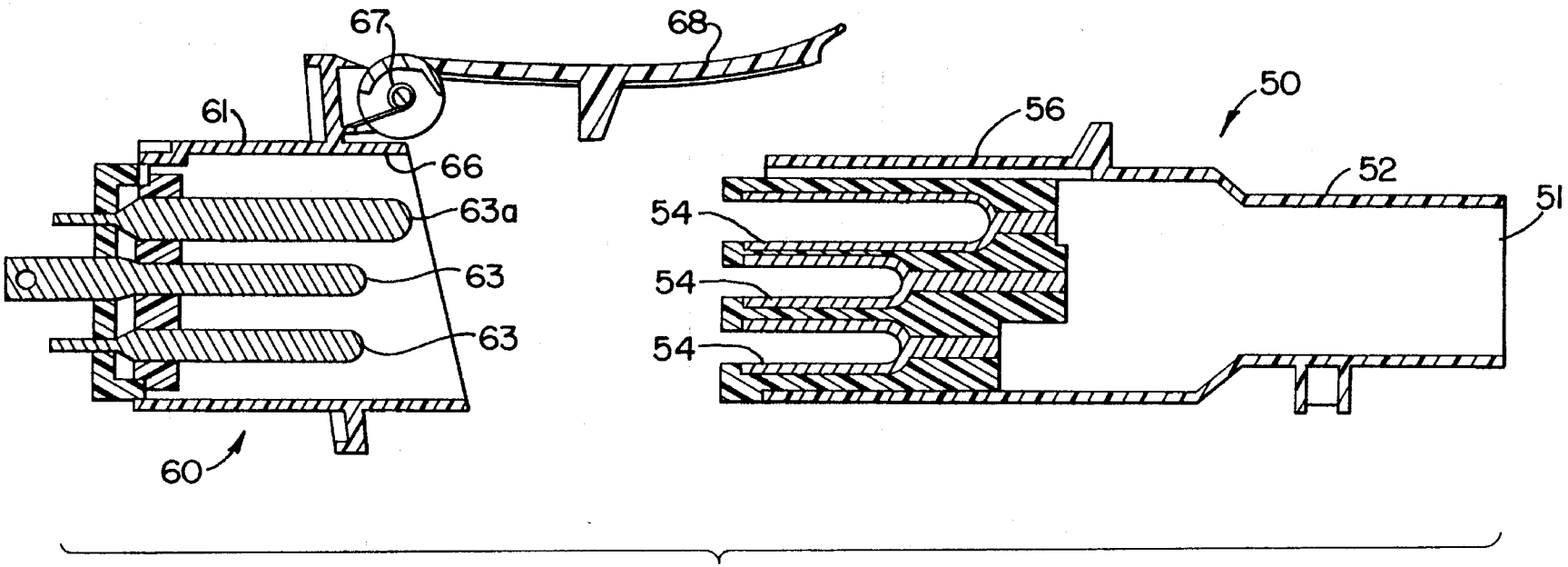
FIG. 4. (PRIOR ART)
FIG. 4 is a cross-sectional view of the prior art J560 connector shown in FIG. 2.
Figure 5:
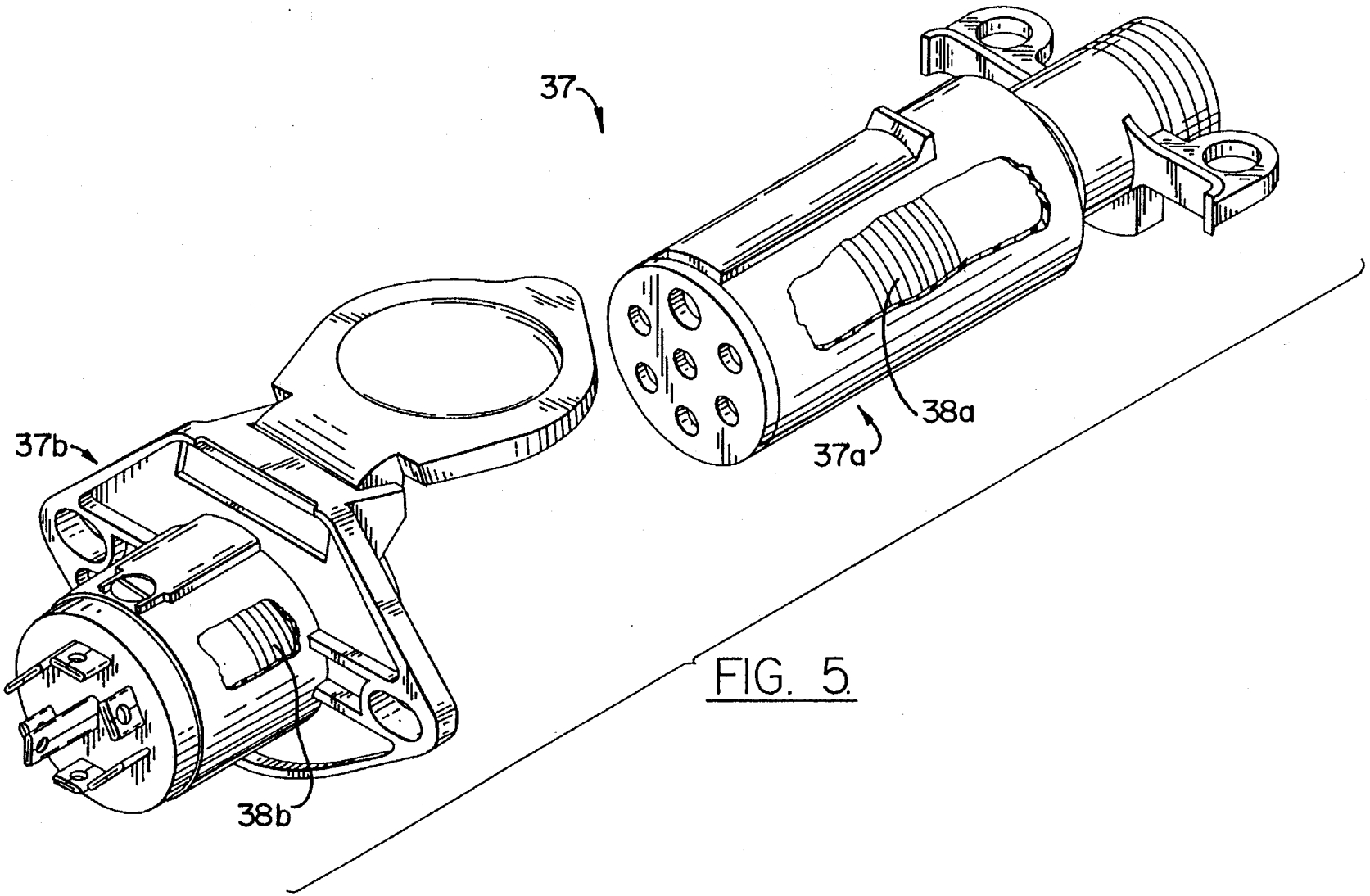
FIG. 5 is an isometric exploded view of a connector as in the present invention.

Referring now to FIGS. 2–4, the J560 connector includes two disengageable portions or halves which, when joined together, will be mounted on the tractor or the trailer. In this fashion, there may be one J560 connector on the tractor or trailer, but alternately, there may be a J560 connector on the tractor and the trailer with a coiled or straight jumper cable connecting the two J560 connectors together when an application requires such an arrangement. The first connector half 50 is provided with an end 51 through which a plurality of electrical conductors, not shown, are positioned and connected to cylindrical contact elements 54 inside the housing 52 of the first connector half 50. The J560 connector has seven such contact elements 54.

A second connector half 60 of the J560 connector includes a housing 61 and is adapted to be mounted using holes 62 to the tractor or the trailer. Inside the second connector half 60, a corresponding plurality of pins 63 are placed which are adapted to mate with and electrically connect with the cylindrical contact elements 54. As discussed above, one of the pins 63*a* is usually an "auxiliary" pin which may or may not be used in a particular tractor/trailer combination 30 to carry power or data between the tractor/trailer. The ends of the pins 63 are adapted to be connected to respective electrical conductors, not shown.

In operation of the seven-pin J560 connector, the first and second connector portions 50, 60 are joined together with a frictional fit so that the pins 63 are matingly received into the cylindrical contact elements 54. A mating protrusion 56 cooperates with a corresponding recess 66 to serve as a key to assure proper alignment of the connector halves 50, 60.

A spring-loaded hinged lid 68 is usually provided to cover the pins 63 of the connector half 60 when the connector halves are disengaged. A spring 67 controls the action of the lid 68.

Referring now to FIGS. 5–9, a connector 37 provided in accordance with the present invention is described. The connector 37 includes disengageable connector portions or halves 37*a*, 37*b* similar to the J560 connector as described. Accordingly, for clarity and brevity of explanation, those elements similar to the J560 connector, including the pins 63 and contact elements 54, will be readily understood by those skilled in the art and need not be repeated.

The connector 37 according to the present invention includes a pair of coils 38*a*, 38*b* carried by respective connector halves 37*a*, 37*b*. The pair of coils provide inductive coupling means as part of a communications channel between the controllers carried by the tractor and trailer. In the illustrated embodiment, the coils 38*a*, 38*b* each include a plurality of wire turns arranged so that the coils are positioned in substantially coaxial and overlapping relation when the connector halves are mated (FIG. 6).

In a preferred embodiment, a signal produced in the tractor/trailer combination is interfaced to one of the two coils to set up in the coil a magnetic field corresponding to the signal to be transmitted. The magnetic field is then communicated to the second coil which is adapted to receive the magnetic field and to have induced in it a voltage corresponding to the signal. The voltage signal is then received by a controller in the tractor/trailer combination so that data can be effectively communicated and used.

Figure 6:
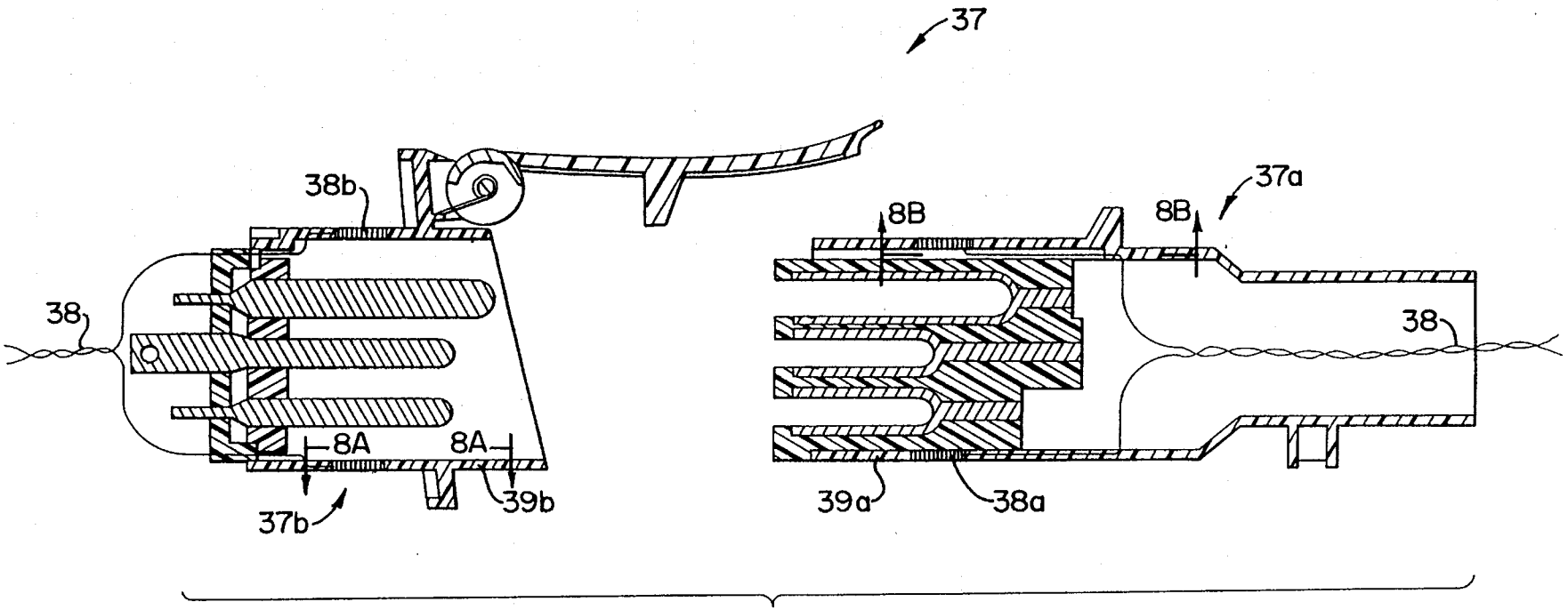
FIG. 6 is a longitudinal cross-sectional view of the connector according to the present invention.
Figure 7:
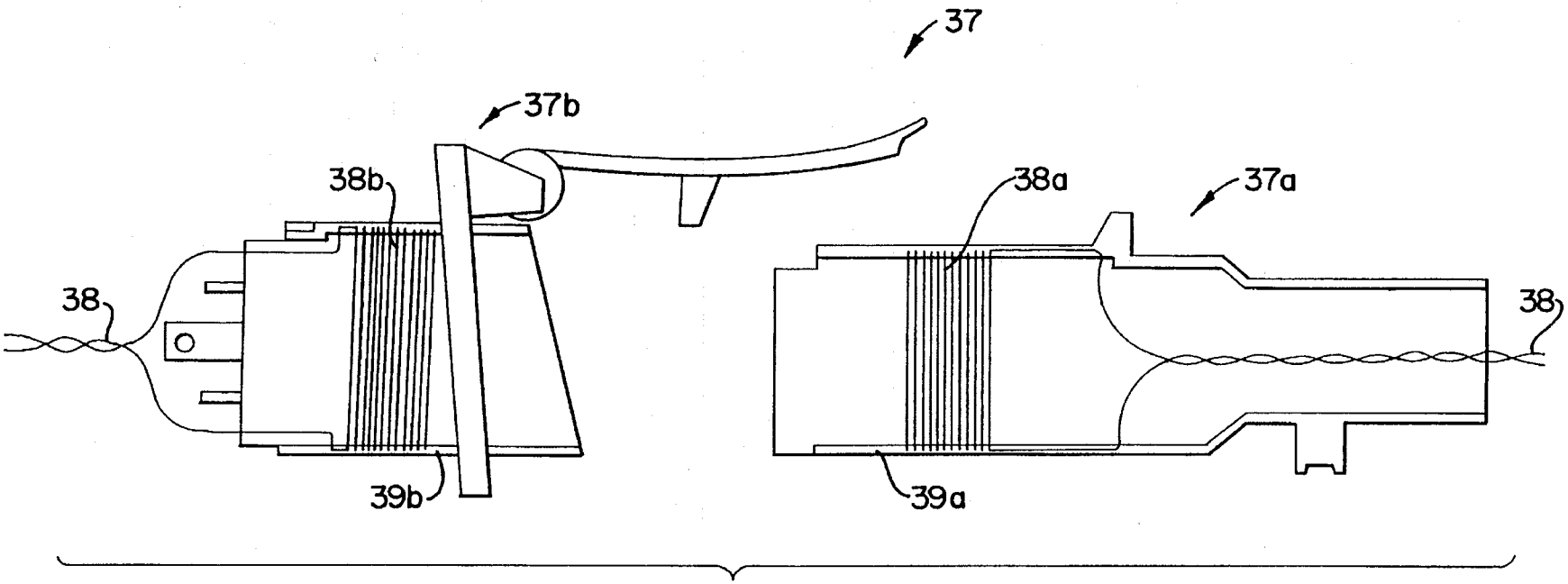
FIG. 7 is a side elevation view of the connector as shown in FIG. 6.
Figure 8A:
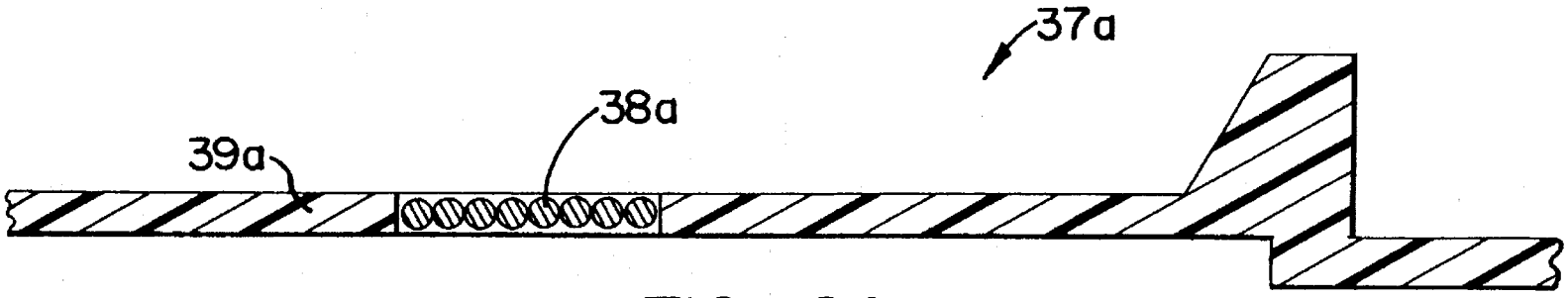
FIGS. 8A and 8B are cross-sectional views of the connector taken along lines 8A and 8B, respectively, of FIG. 6.
Figure 8B:
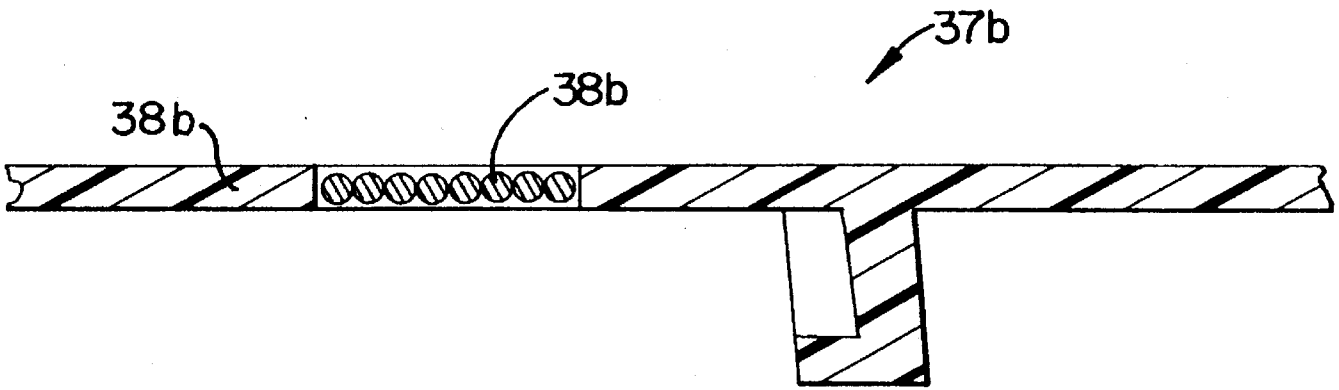

Referring now to FIG. 6 in particular, a cross-sectional view of the connector 37 provided in accordance with the present invention is illustrated including the first and second coils 38*a*, 38*b*. The first coil 38*a* is mounted in the first connector half 37*a* by preferably winding the coil from wire on or embedded into the connector shell or housing 39*a*. Similarly, in the second connector half 37*b*, the second coil 38*b* is similarly wound and mounted to the shell or housing 39*b* of the second connector half 37*b*. A length of twisted pair cable 38 is connected to the coils 38*a*, 38*b* and extends to the respective controllers 35, 36. It will be recognized by those with skill in the art that other communication cables such as coaxial cables, twin axial cables and others, could be used in place of the twisted pair cable.

Figure 9:
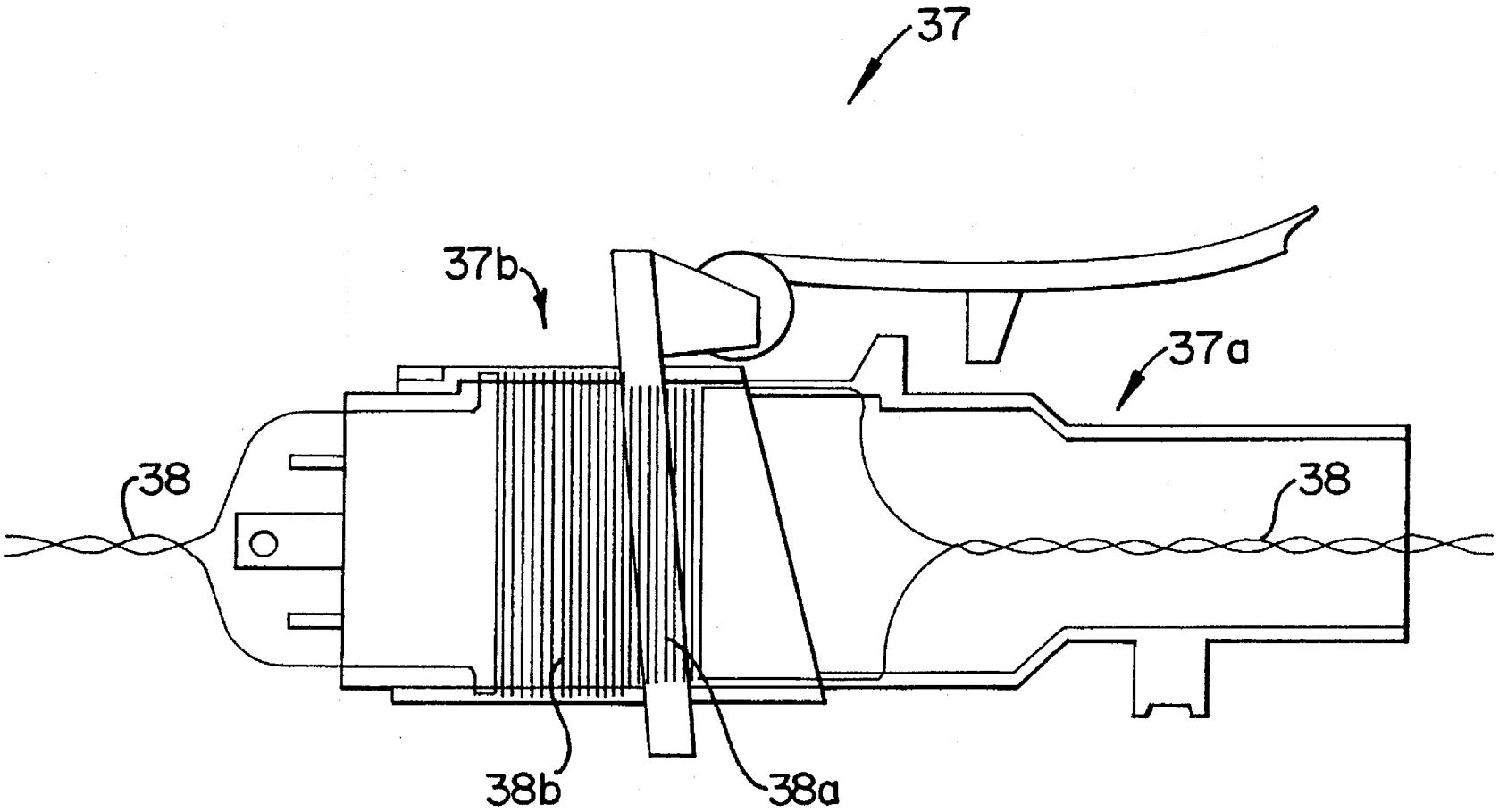
FIG. 9 is a side elevational view of the connector of FIG. 6 illustrated in the coupled position.

When the first and second connector halves 37*a*, 37*b* are joined together as best shown in FIG. 9, communication across the connector is possible by inducing voltages in the coils as described above. In other words, the coils 38*a*, 38*b* act in a transformer arrangement as the primary and secondary windings of a transformer, respectively. The connector 37 according to the present invention permits data communication across a connector compatible with the J560 standard.

Figure 10:
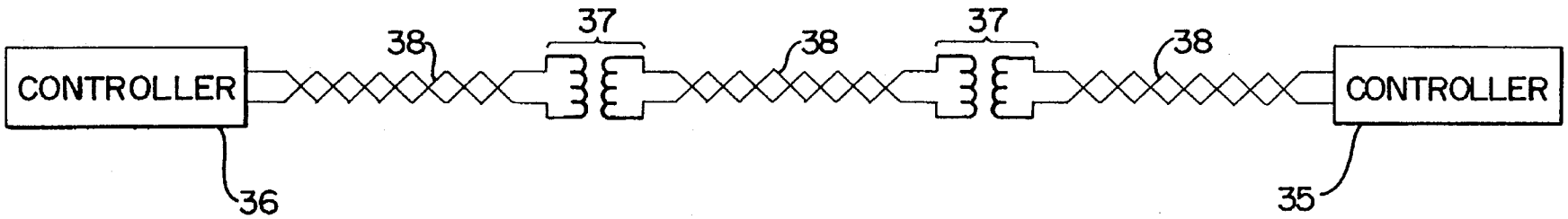
FIG. 10 is a simplified schematic diagram of the communications system according to the present invention.

It should also be noted that the magnetic or inductive coupling efficiency of coils 38*a*, 38*b* of the connector 37 in accordance with the present invention is sufficient to support back-to-back connections of two such connectors without requiring signal regeneration or amplification. As shown in FIG. 10, a system is illustrated which includes back-to-back communications channels employing two connectors 37 in accordance with the present invention. In one embodiment of the controllers 35, 36 a data waveform is impressed upon a 2.5 MHz sine wave carrier by amplitude modulation (AM). The modulation is preferably carried out such that a low level data bit referred to as a "space condition" results in full amplitude transmission, while a high level or "mark condition" results in a zero amplitude transmission. Demodulation of the data is preferably accomplished by the commonly known technique called "diode detection" wherein the modulated carrier is passed through a half-wave circuit which acts as a low pass filter such that the high frequency carrier is blocked, leaving the low frequency data to pass through the circuit. In point-to-point (one tractor and one trailer) communications, AM is the preferred method to encode the data. Other encoding techniques will also be readily usable, and those with skill in the art will be able to readily execute such techniques with circuits provided in accordance with the present invention.

Figure 19:
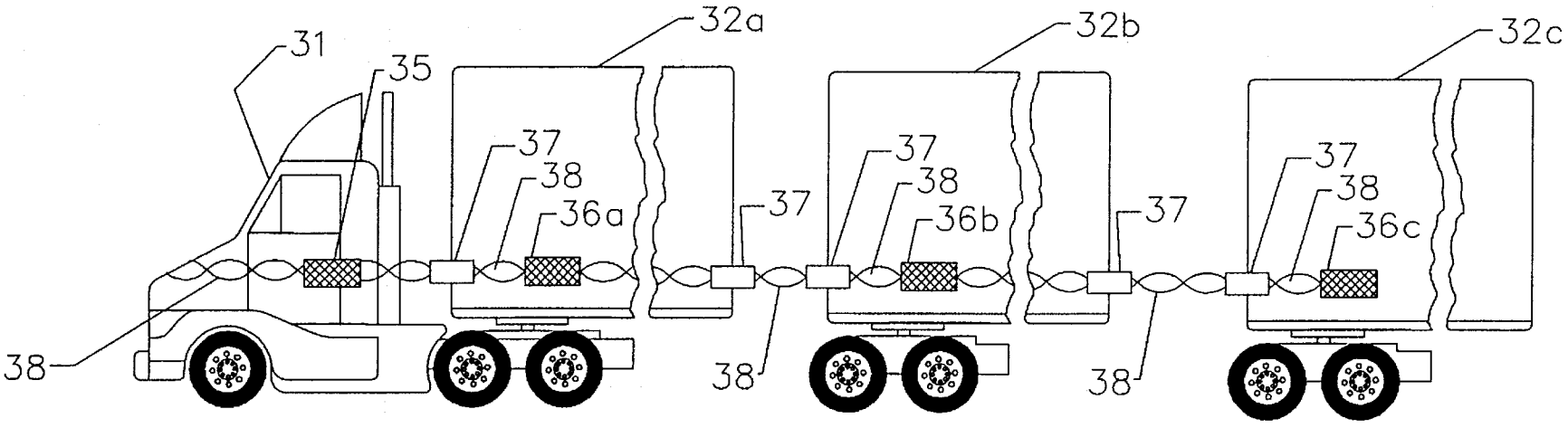
FIG. 19 is a schematic diagram of a tractor/multi-trailer combination according to the present invention.

Frequency shift keying (FSK) and spread spectrum are the preferred modulation schemes in a multidrop network because multiple controllers can be connected in series or in parallel. A multidrop network might exist, for example, when a tractor 31 tows more than one trailer. A series of trailers 32*a*, 32*b*, 32*c* may carry respective controllers 36*a*, 36*b*, 36*c* all inductively coupled to a single tractor controller 35, as shown in FIG. 19. Each controller 36*a*, 36*b*, 36*c* of respective trailers 32*a*, 32*b*, 32*c* would have its own unique identification address.

Figure 18:
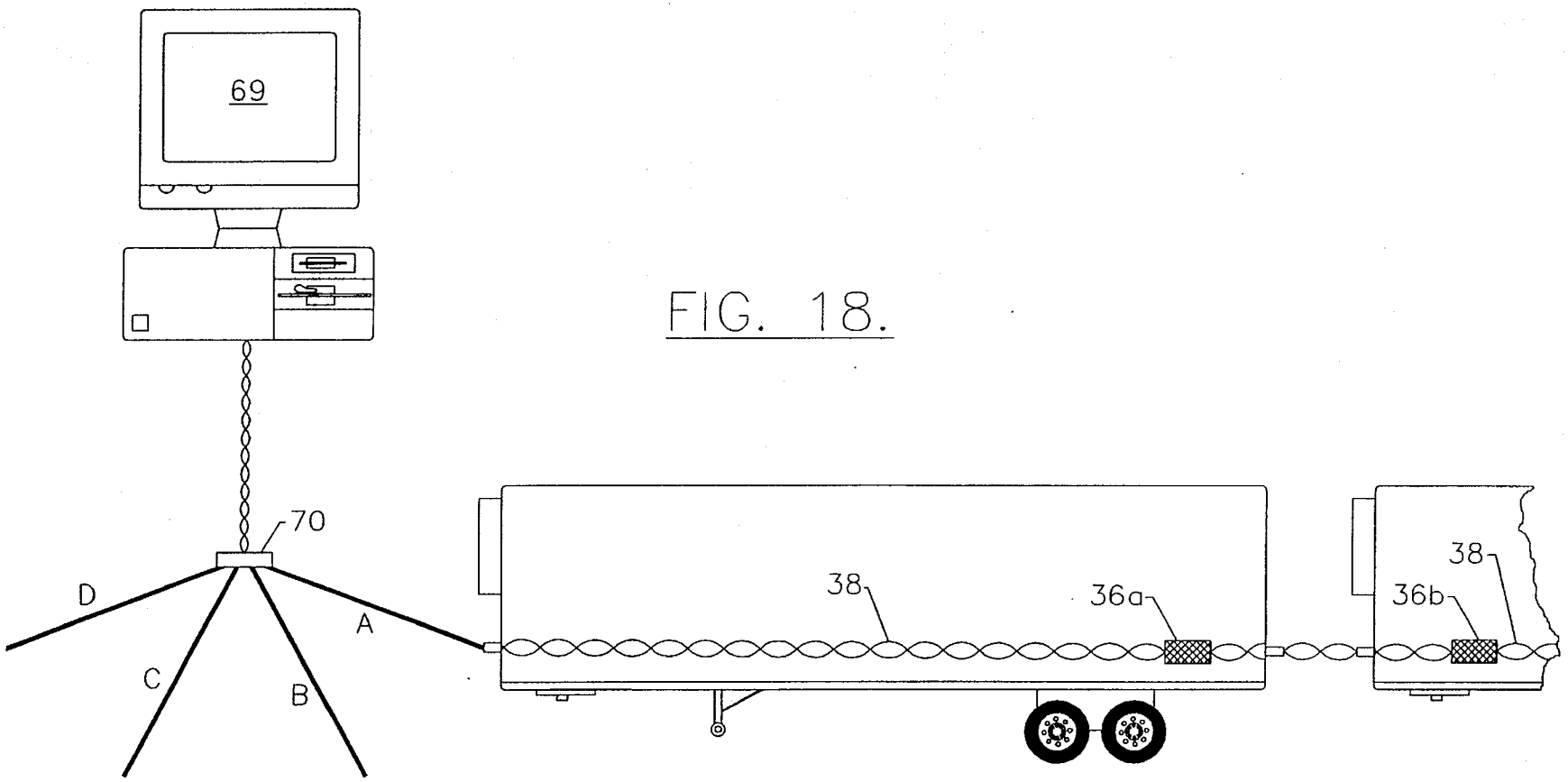
FIG. 18 is a schematic diagram of the controller of the trailer interfaced with an external controller.

Alternatively, a multidrop network could also be advantageously used for a railroad train carrying multiple trailers 32 on its flat cars. For example, some subsystems 40 in refrigerated trailers carrying perishable goods would still be monitored or controlled. Referring to FIG. 18, an external controller 69 is shown connected to a number of trailers (not shown) by a number of parallel lines A, B, C, D. The external controller 69 includes processor means for storing and retrieving data from each controller of the respective trailers 32. A communications connector 70 using inductive coils as described herein permits multiple trailer connection.

Figure 11A:
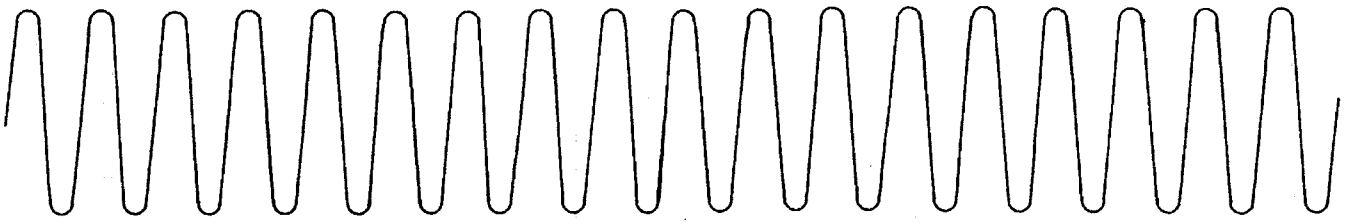
FIGS. 11A–11C are schematic waveform diagrams illustrating a communication protocol for the communications system according to the present invention.
Figure 11B:
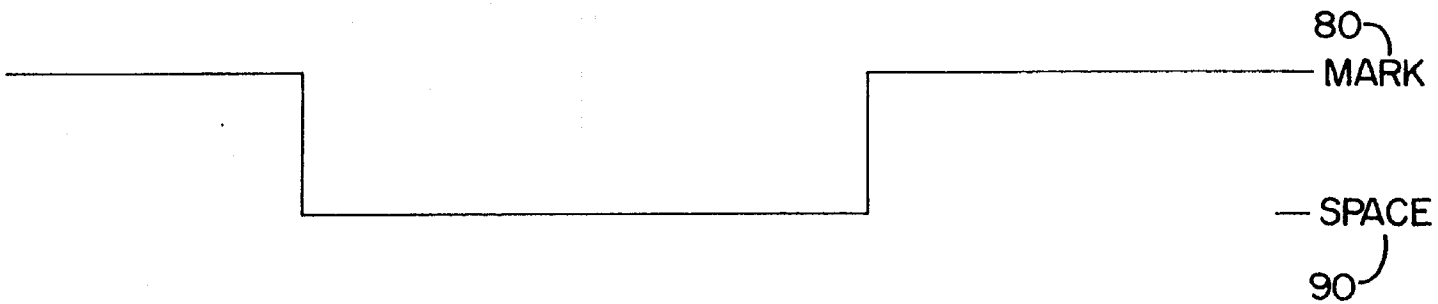
Figure 11C:
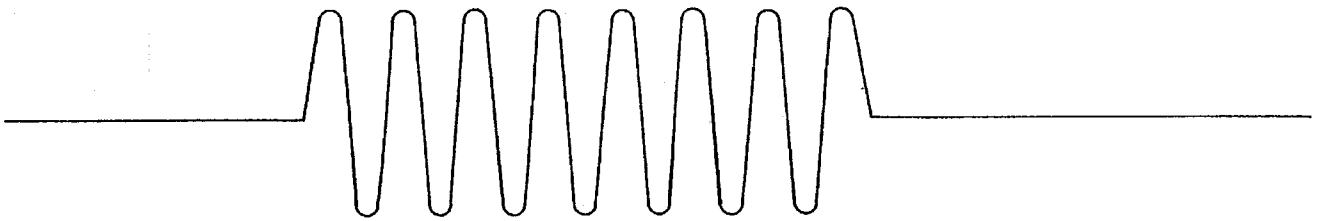

Referring to FIGS. 11A–11C, the AM technique used with the present invention is illustrated. FIG. 11A shows the 2.5 MHz sine wave carrier which carries the data. FIG. 11B shows the modulating voltage bi-level data signal wherein the mark or high level data bit 80 results in zero amplitude transmission, and the space or low level data bit 90 results in full amplitude transmission. The amplitude modulated carrier signal is shown in FIG. 11C. Thus, the inductive coupling in accordance with the present invention permits the establishment of a bi-directional communications, bi-level voltage channel across a connector 37 compatible with the J560 standard.

Figure 12A:
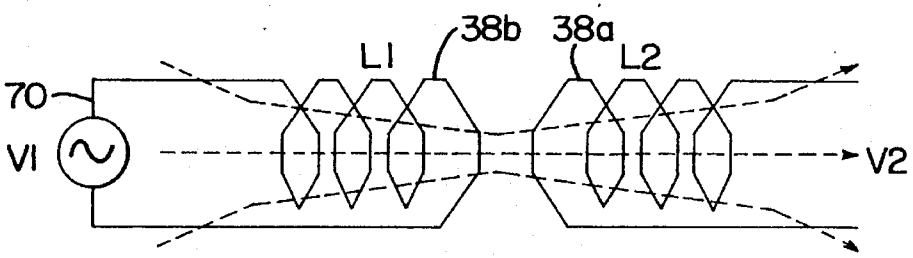
FIGS. 12A–12D are schematic equivalent circuit diagrams of the connector according to the present invention.
Figure 12B:
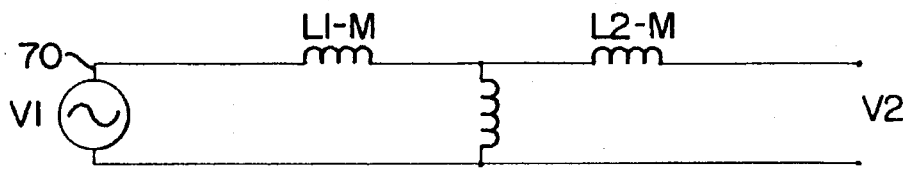
Figure 12C:
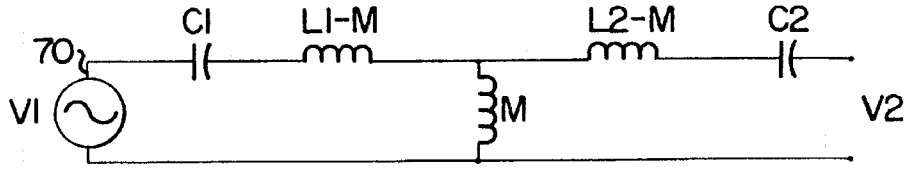

Referring to FIGS. 12A–12D, schematics of the inductively coupled coils 38*a*, 38*b* in accordance with the present invention and equivalent circuit models for the coils are shown. As mentioned above, the circuits are magnetic or inductive in nature and thus. operate on the principle of mutual magnetic or inductive coupling known to those with skill in the art. As shown in FIG. 12A, the connector 37 includes two multi-turn coils 38*a*, 38*b* made of electrically conducting wire which are brought into close but noncontacting relation, that is, into inductive coupling relation. A time variant voltage ($V_1$) modulated by the information to be conveyed is applied across coil 38*b* which causes a time variant current to flow in coil 38*b* in accordance with the well known physical relationship:

$$V_1 = L \cdot DI/dt,$$

where $V_1$ is the applied voltage, L is the coil self-inductance, I is the current, and t is time.

The time variant current, I, through coil 38*b* causes a proportional time variant magnetic field to be set up parallel with and through the coil axis. This time variant magnetic field causes a time variant voltage to be induced in the other coil 38*a* in close proximity to the first coil 38*b* in accordance with the well known magnetically induced voltage law:

$$V_2 = -N \cdot d\phi/dt,$$

where N is the number of turns in coil, and $\phi$ is the magnetic flux from the first coil 38*b* passing through the area enclosed by the turns, N, of the second coil 38*a*.

When the coils 38*a*, 38*b* are perfectly coincident such that all the flux generated by one coil passes through the other coil, the system is referred to as an "ideal transformer." In this case, the voltage impressed upon coil 38*b* is reproduced through the second coil 38*a* in direct proportion to the ratio of turns of the two coils.

However, when the two coils are not perfectly coincident, some of the flux generated by one coil 38*b* does not pass through the second coil 38*a*. The voltage induced in the coil is thus less than that given by the turns ratio of the coils. The portion of coil self-inductance which is not mutually coupled to the other coil is referred to as the system's "leakage inductance" and represents a loss term in the network analysis. In this situation, and referring to FIG. 12B, the two inductively coupled coils 38*a*, 38*b* may be modelled by the equivalent circuit shown. In this circuit, "M" represents the mutual or shared inductance of the two coils while $L_1$–M and $L_2$–M represent the leakage or non-shared inductance of coils.

Figure 12D:
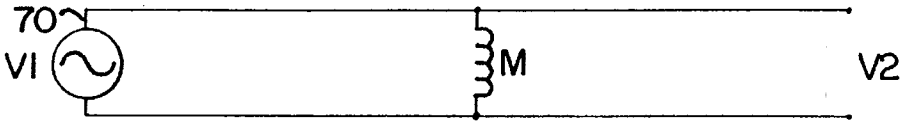

In order to minimize the signal loss at the output $V_2$ due to the voltage drop across the leakage inductance, the two leakage components are preferably reactively tuned out at the carrier frequency by the addition of series tuning capacitances, $C_1$ and $C_2$, on each coil. The capacitance values $C_1$ and $C_2$ should be chosen so that the resulting resonance of the series capacitance and inductance combinations will result in the leakage being removed from the equivalent circuit. Thus as shown in FIG. 12D, all the signal voltage $V_1$ applied to coil 38*b* will be reproduced across coil 38*a* as voltage $V_2$. Naturally, there will be resistive loss components which are not shown in this circuit model which will also result in signal losses which cannot be tuned out. Consequently, there will always be a resistive loss of signal amplitude in this circuit.

The circuit schematic and equivalent circuit models of FIGS. 12A–12D illustrate a preferred embodiment wherein coils 38*a*, 38*b* are mated concentrically or coaxially rather than end to end. Prototype designs of this preferred embodiment have yielded magnetic or inductive coupling efficiencies in excess of 60%. The coils 38*a*, 38*b* were wound using 30 gauge enamel insulated, solid copper wire to achieve equal self-inductance in the coils. This produced an inductance of 25.5 μH wherein an inner coil, preferably coil 38*b*, requires 21 turns, and the outer coil, preferably coil 38*a*, requires 18 turns. Since the mutual inductance M is the same for both coils, the leakage inductances $L_1$–M and $L_2$–M, are also equal.

With a 65% coupling coefficient, the leakage inductance is given by:

$$L_1-M=L_2-M=(1.00-0.65)\cdot 25.5\ \mu H=8.9\ \mu H.$$

This leakage inductance is tuned out at the carrier frequency with the addition of resonant capacitances of 455 pF in series with each coil. The reactance of the remaining mutual inductance, $X_M$, is substantially 260 Ω and the loss resistance associated with each coil is on the order of about 13 Ω.

It is apparent that the connector housing or outer shells 39*a*, 39*b* must of necessity be made of an electrically non-conductive material. The time variant magnetic field of the coils will induce eddy currents into any adjacent conductive materials, and the finite resistance of the materials under the influence of these currents will represent a large loss component in the system.

Since the seven-pin contact assemblies of the standard J560 seven-pin connectors are highly conductive, they could be expected to contribute significantly to the loss component. However, it has been found that the loss due to the seven-pin contact assemblies is insubstantial. Furthermore, since the outer shells 39*a*, 39*b* will preferably be injection molded from glass-nylon which is not substantially conductive, no loss component will be introduced from the outer shells.

It is readily appreciated by those skilled in the art, that the length of twisted pair cables 38 will exhibit distributed circuit characteristics of electrical transmission lines when the cable length approaches 1/16 of the electrical wave length. The wave length of a 2.5 MHz carrier is 394 feet, and so the transmission line effects will be observed in any length of twisted pair cable in excess of about 25 feet. Since cable lengths in excess of 90 feet are anticipated in a typical tractor/trailer combination, transmission line practices must be employed.

A transmission line which is not terminated by an impedance equal to its own characteristic impedance will exhibit reflections of an applied incident voltage waveform. The reflected wave will in turn set up a voltage standing wave pattern wherein the peak voltage goes off from a maximum as the distance from the voltage source is increased. The voltage standing wave pattern amplitude will drop off to a minimum at a distance equal to about ¼ of the wave length from the source, and rise to a maximum again at about half the wave length from the source, where the wave will repeat itself. Thus a system which exhibits a substantial standing wave pattern will require calibration of the MODEMS in each controller 35, 36 for each configuration of transmission line length.

In order to minimize the effect of standing wave patterns on transmission signal amplitude for the entire range of applicable transmission lengths, the MODEMS must present an input and output impedance as closely matched as possible to the characteristic impedance of the twisted pair cable 38. In preferred embodiments, the characteristic impedance of twisted pair cable 38 will be about 120 Ω.

It is equally important that the reactance of the mutual coil inductance be insignificant compared to the characteristic impedance of the cable or the terminal impedance will no longer match the cable characteristic impedance. The reactance of the mutual inductance of prototype connectors tested in accordance with the present invention was about 260 Ω, which was about twice the characteristic impedance of the cable. This is not an insignificant reactance; however, by increasing the number of turns in the coils, thus the mutual inductance and reactances, resistive loss components are introduced to the system which themselves become significant compared to the characteristic impedance. The selection of coil inductance should therefore be based upon an optimization of signal amplitude between the divergent effects of mutual reactance and the cable termination and reactive loss components in the coil assemblies.

The mutual reactance and resistive loss effects become pronounced with an increase in carrier frequency, that is, the transmission line effects become increasingly influential with increasing frequency at ever shorter cable lengths. Similarly, resistive loss components become substantially more pronounced as a result of the higher frequency magnetic properties of the materials. However, demodulation of the data signal is a relatively simple process if the carrier frequency is several orders of magnitude higher than the data frequency, but will become more complicated as the two frequencies approach one another. Accordingly, the selection of the carrier frequency should be based on an optimization of the cost, complexity and performance between the divergent effects of frequency on demodulation, and magnetic physics and transmission line effects.

A connector 37 and other communication channel components provided in accordance with the present invention allow the interconnection of intelligent computer systems on a vehicle such as tractor/trailer combinations. Since prior J560 connector assemblies are routinely subjected to the harshest environmental conditions, including temperature extremes, severe vibration, dirt and corrosive atmospheres, it is not uncommon to find that dirt buildup and/or loosening of the contacts from prolonged excessive vibration in the current seven pins have reduced the integrity of the connection to the point where subsystems on the tractor/trailer are non-functional. Furthermore, oxidation of connector contacts is expected which is usually counteracted by the high currents passed through the seven pins. The advantage of the connector 37 and communications channel of the present invention will be recognized by those with skill in the art since no contacts are employed, and no oxidation and dirt buildup will then cause signal degradation.

Communications provided in accordance with the present invention are also immune to the effects of extreme vibration, since efficient magnetic or inductive coupling is maintained as long as the connector halves are properly mated. Tests on prototype connectors have shown that the halves may be separated in excess of one-half inch before communications are interrupted. Furthermore, the communications channel and connector 37 of the present invention are inherently differential, and so the isolation afforded by the inductive coupling provides a high degree of immunity to common mode noise and voltage drops in ground circuitry. The voltage induced in a coil depends almost entirely upon the voltage difference impressed across the other coil without regard to any ground reference.

The connector 37 described herein is essentially a radio frequency (RF) datalink with data signals carried by a twisted pair cable 38. This connector avoids the problems associated with wireless RF datalinks, namely differentiating between valid network nodes and those of another network in close proximity, and lower data throughput rates resulting from bandwidth limitations of the carrier frequency. In this fashion, the connector 37 provided in accordance with the present invention maintains strictly point-to-point communications at all times. Furthermore, since the coils 38*a*, 38*b* are embedded in the connector housings or outer shells 39*a*, 39*b*, they are not exposed to corrosive elements which may be present.

Referring now to FIGS. 13–16 other aspects of the communications system are more fully described, particularly in relation to the controllers 35, 36. In particular as shown in the schematic diagram of FIG. 16, a controller 35 carried by the tractor is illustrated, it being understood the controller 36 carried by the trailer is similar. The controller 35 in the illustrated embodiment includes a microprocessor or microcomputer 100 operating under stored program control to perform various functions related to the monitoring and control of various electronic subsystems on either or both of the tractor and trailer.

The controller 35 includes modulator/demodulator means 101, such as a conventional modem for implementing the modulation scheme described in detail above, for establishing a bidirectional communication link with the corresponding controller 36 via a pair of inductively coupled coils 38*a*, 38*b* of the connector 37. In addition, a multiplexor is preferably implemented by the microprocessor 100 for multiplexing a plurality of input signals as would be readily understood by those skilled in the art. A demultiplexor is also preferably implemented by the microprocessor 100. In addition, a serial data bus interface 104 is also preferably provided for communicating with a plurality of data transceivers 105 carried by the tractor or trailer as described, for example, in the SAE Recommended Practice J1708. A UART (Universal Asynchronous Receiver/Transmitter) 103 is preferably provided for cooperating with the MODEM and serial data bus interface 104 to facilitate data communications as would be readily understood by those skilled in the art.

The controller 35 also further includes digital interface means 108 for interfacing with digital input signals relating to operation of the tractor or trailer, or to generate digital output signals for operation of the tractor or trailer. In addition, the controller 35 also preferably includes analog interface means 110 for interfacing with an analog input signal relating to operation of the tractor or the trailer, or for generating an analog output signal for operation of the tractor or the trailer.

To facilitate diagnostics of the controller 35, and hence the vehicle, the controller also includes memory means 112 for storing data related to operation of the tractor 31 or trailer 32. A display 115 is also preferably connected to at least the controller 35 carried by the tractor 31 to record and display to the driver information relating to operation of the vehicle. A diagnostic connector 113 on the tractor 31 may also be provided to permit connection to the external controller 69. The external controller 69 includes a processor for storing data to and retrieving data from the tractor controller 35. The external controller 69 may also troubleshoot the system as would be readily appreciated by those skilled in the art. Thus, a technician or mechanic would have the option of running diagnostic tests on the entire tractor/trailer combination (when enabled by the present invention) via the diagnostic connector 113. Diagnostic tests of the tractor 31 alone could be performed using either the diagnostic connector 113 or by connecting the external controller 69 through the inductive connector 37 to the tractor 31.

To further illustrate those electronic subsystems which may be readily incorporated into the present invention, TABLE 1 below gives a partial listing of such subsystems and features which may be controlled and/or monitored by the controllers 35 and 36.

TABLE I

| TRACTOR | TRAILER |
|---|---|
| ♦ Mirror Tracking | ♦ Reefer Temperatures |
| ♦ Mirror with Trailer Displays | ♦ Reefer Pressures |
| ♦ Controls for Reefer (Engine) | ♦ Trailer Identification |
| ♦ Controls for Trailer Slide Axle | ♦ Blind Spot Warning |
| | ♦ Cargo Information |
| ♦ Controls for Landing Gear | ♦ Smoke/Fire Detection |
| ♦ Active Faring | ♦ Overfill (Tanker) |
| ♦ Recorder for Trailer Functions | ♦ Cargo Shift |
| ♦ Satellite for Trailer Functions | ♦ Weight Detection |
| ♦ Brake System Information | ♦ Anti-Lock Failure |
| ♦ Brake By Wire | ♦ Brake By Wire |
| ♦ Climate Controls for Reefer | ♦ Backup Lamps |
| | ♦ Suspension Control |
| | ♦ Sliding Axle Control |
| | ♦ Liftable Tailgate |
| | ♦ Tire Pressure Monitor |
| | ♦ Lamp Outage Monitor |
| | ♦ Stop Lamp Saver (with Doubles and Triples) |

TABLE I-continued

| TRACTOR | TRAILER |
|---|---|
| | ♦ Water in Air Reservoir<br>♦ Liftable Landing Gear<br>♦ Brake Temperature |
| ♦ Mirror with Trailer Display<br>♦ Trailer Identification<br>♦ Trailer Brake Temperatures<br>♦ Trailer Axle Temperatures<br>♦ Trailer Security<br>♦ Weight Broadcast<br>♦ Trailer Voltage Status | ♦ Emergency Line Pressure Detection<br>♦ Blind Spot Warning<br>♦ Cargo Information<br>♦ Tire Pressure Warning<br>♦ Smoke Detector<br>♦ Roll Over Protection<br>♦ Active Conspicuity (Lighting)<br>♦ Active Tire Pressure<br>♦ Backup Alarm<br>♦ Inventory Data Collection<br>♦ Security Warning<br>♦ Trailer Engine Start<br>♦ Trailer Engine Monitor<br>♦ Tractor/Charging from Reefer<br>♦ Trailer Dome Lamps<br>♦ Rear Door Lift (Motorized) |

Figure 13:
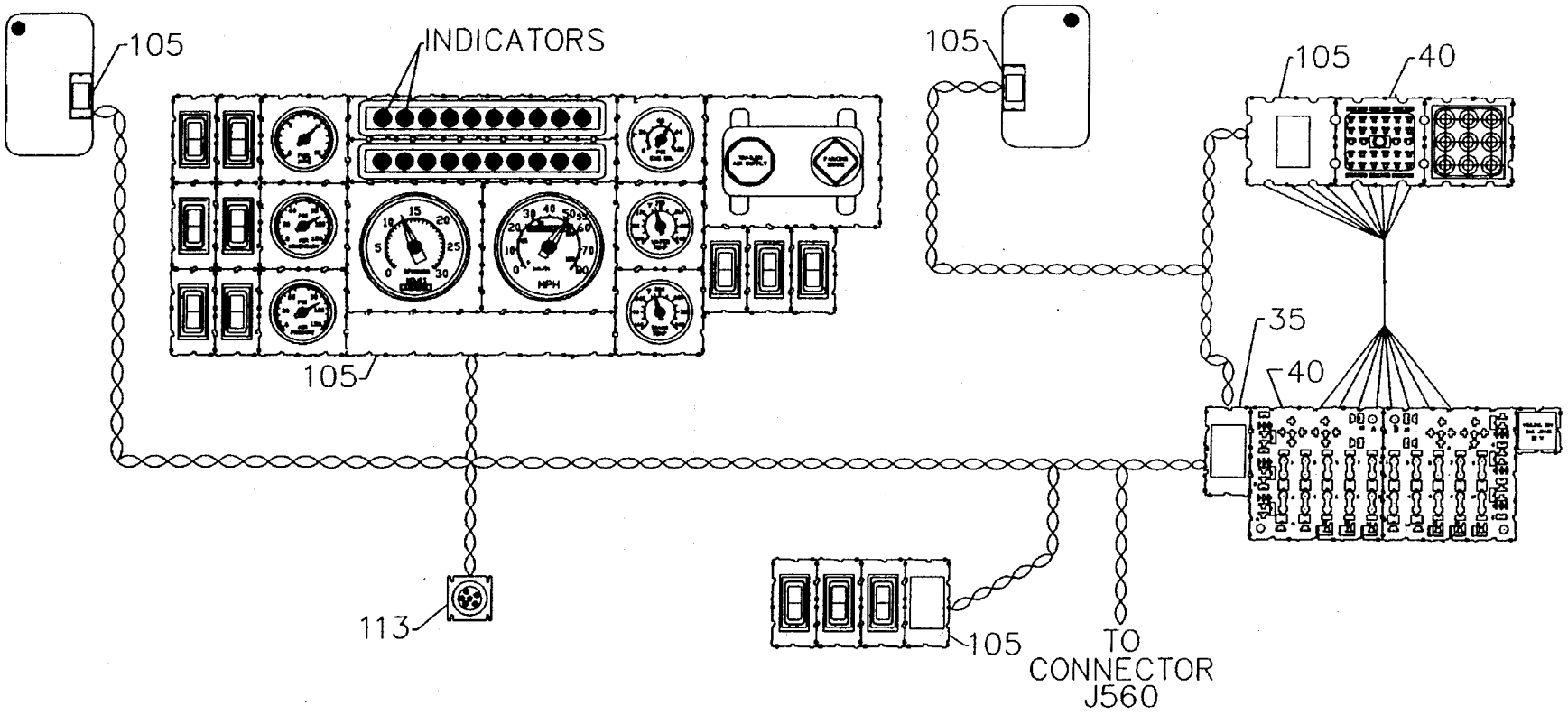
FIG. 13 is a schematic diagram of a controller and other modules of the communications system of the present invention connected to various electronic subsystems of a tractor.
Figure 14:
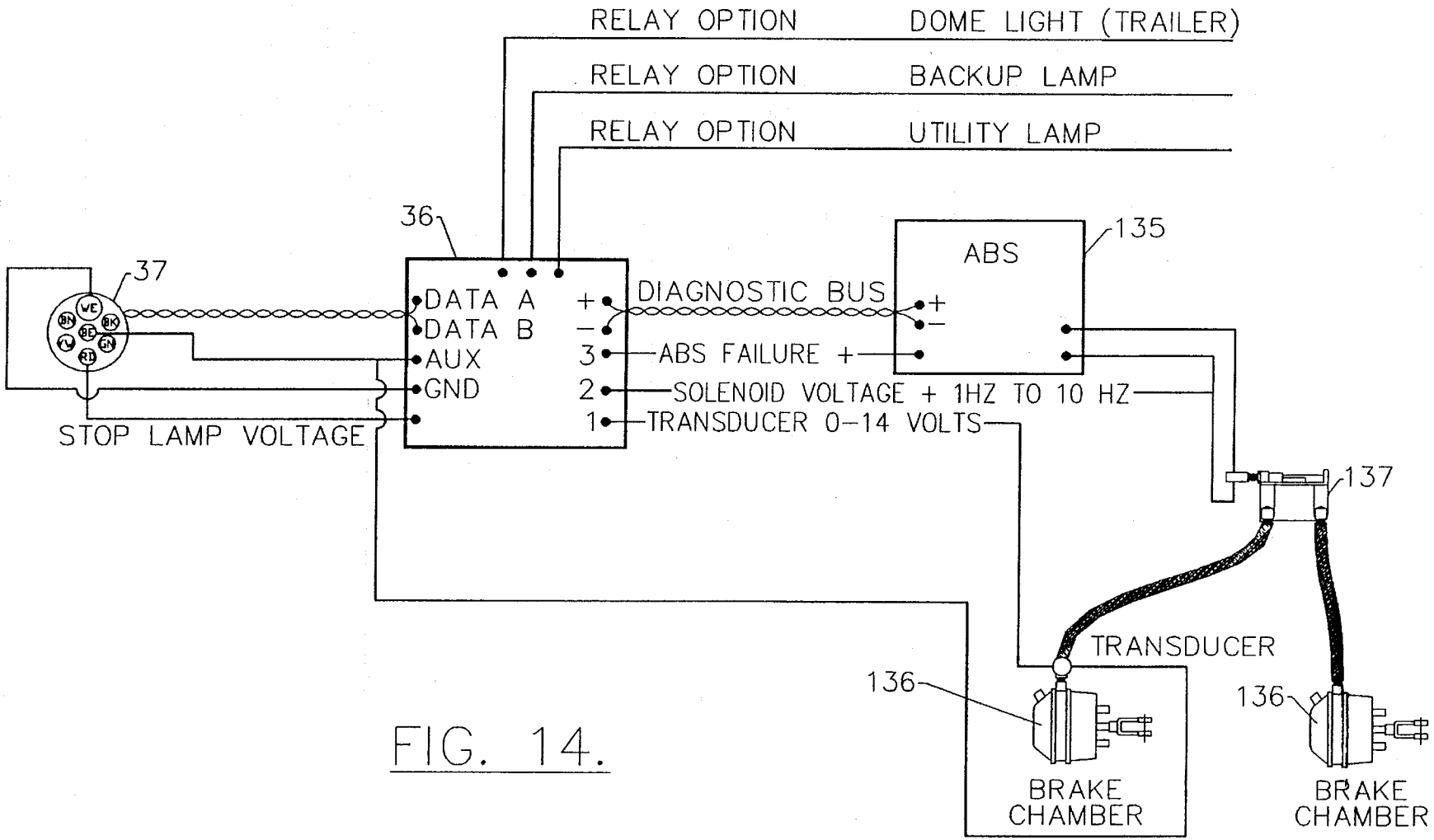
FIG. 14 is a schematic diagram of a controller connected to an ABS module on a trailer according to the present invention.

To further explain the operation of the controller 35, FIG. 13 schematically illustrates a tractor including a controller 35 and a plurality of transceivers 105 connected thereto. The transceivers collect information from various subsystems 40 and communicate the data to the controller 35. The controller 35 then outputs display signals to the tractor display unit 115 (FIGS. 15 and 16).

Figure 15:
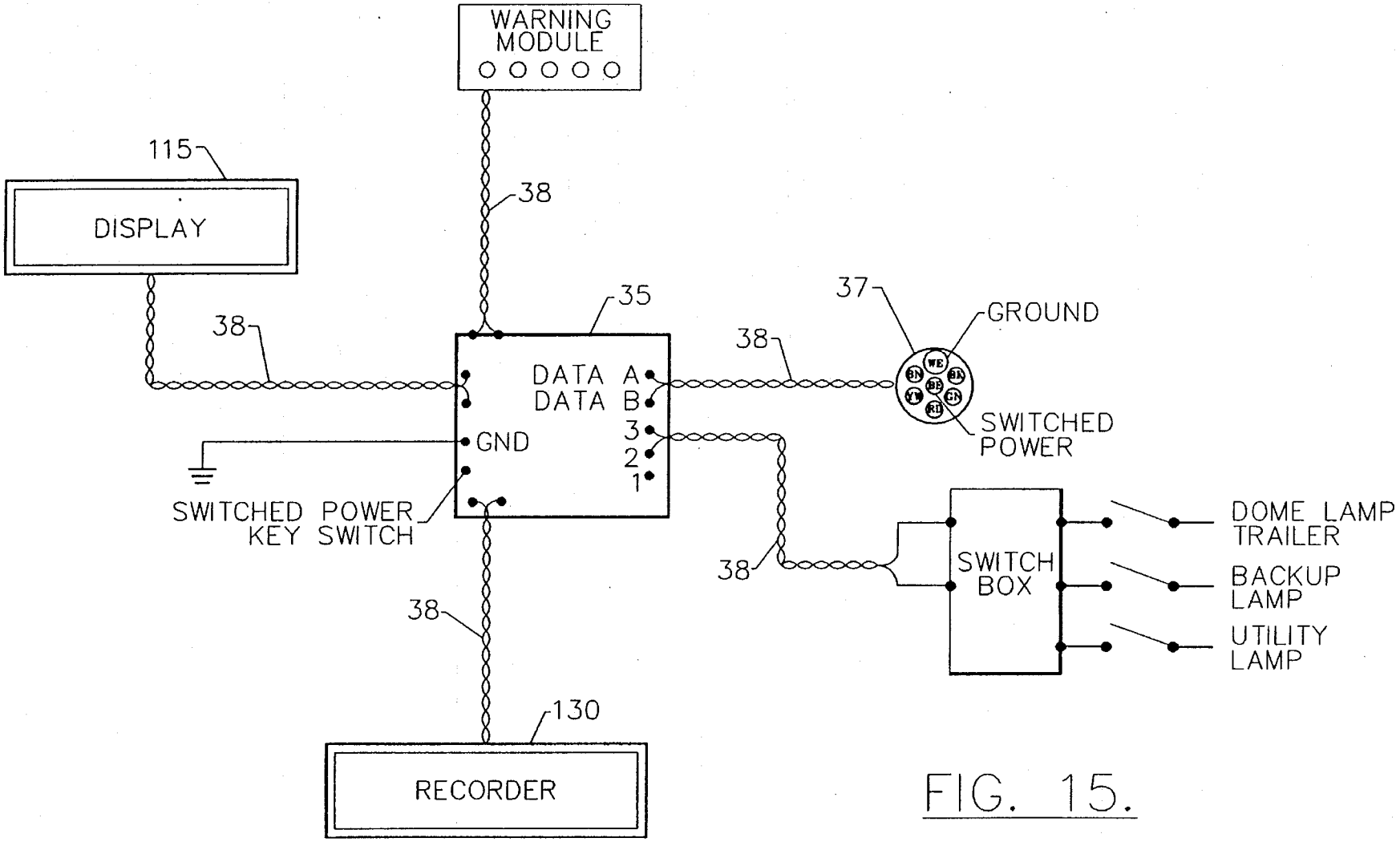
FIG. 15 is another schematic diagram of a controller connected to various subsystems of a tractor according to the invention.

FIG. 15 is a further illustration of the controller 35 of the present invention connected to various subsystems in the tractor. In particular, the controller 35 is connected to a recorder 130, which may be a "black box" type recorder which is well known to those with skill in the art.

Figure 16:
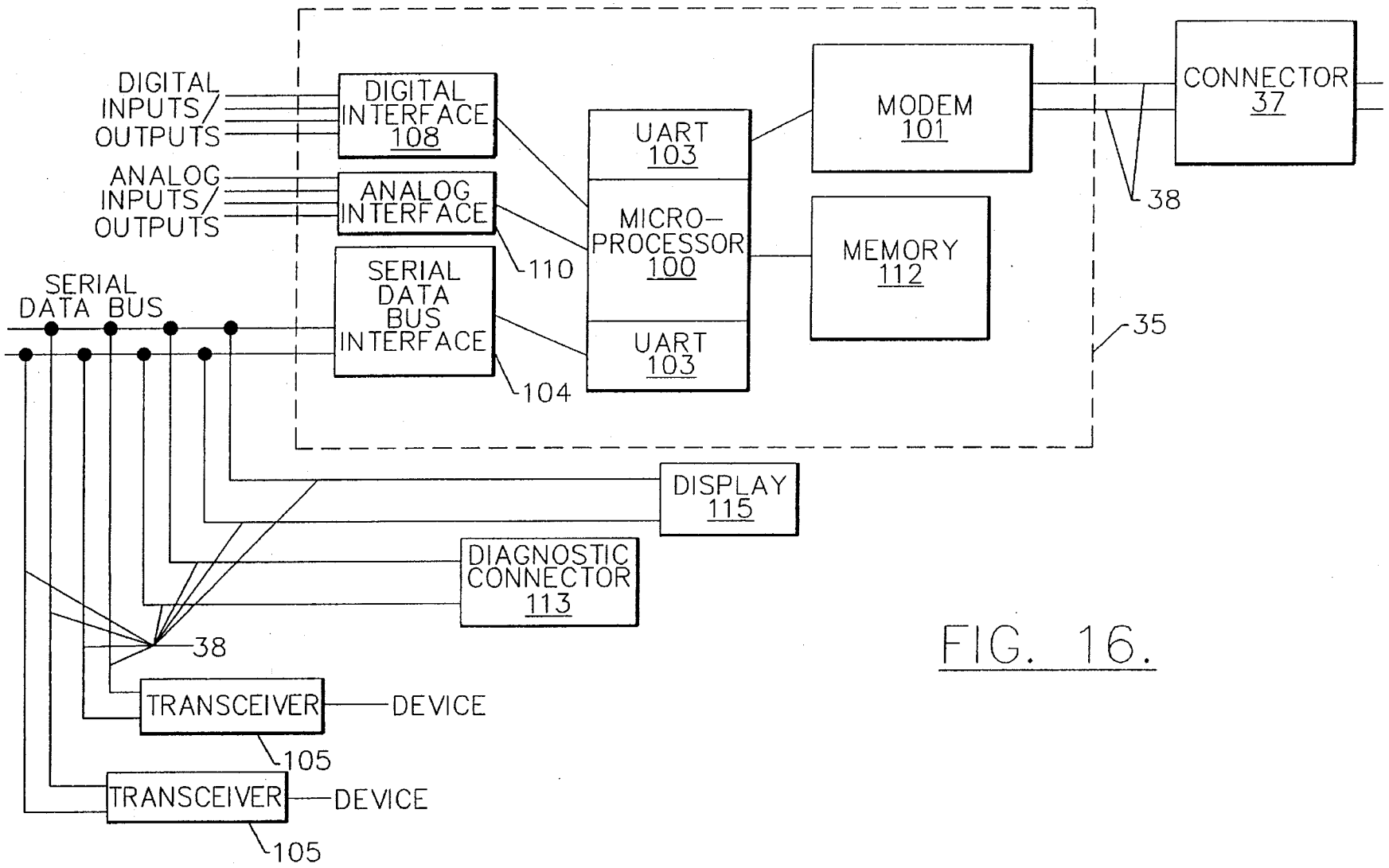
FIG. 16 is a detailed schematic diagram of a controller according to the invention.
Figure 17:
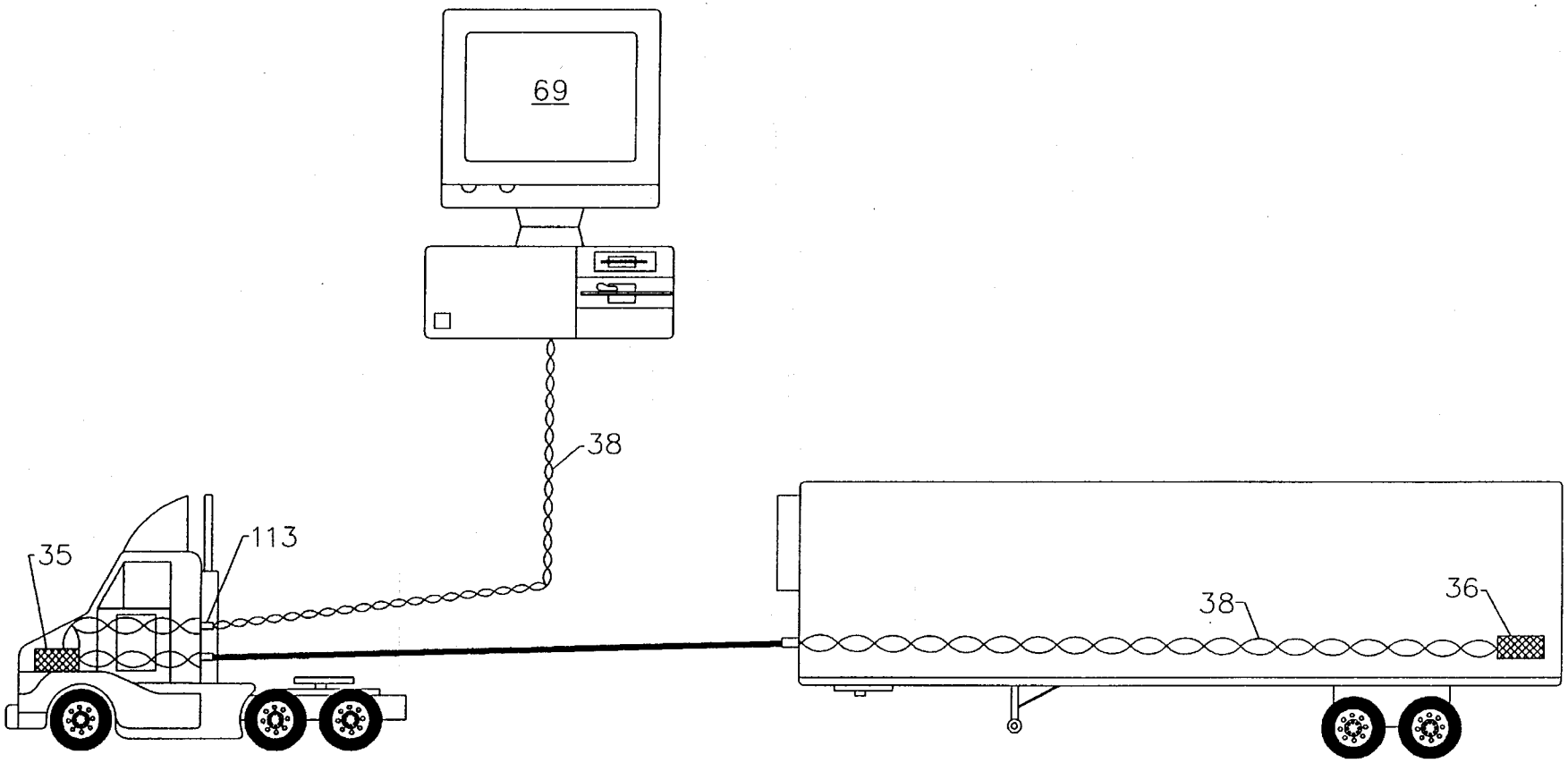
FIG. 17 is a schematic diagram of the communications system according to the invention interfaced with an external controller.

FIG. 16 illustrates an example of the functions of the controller 36 for the trailer. In particular, the controller 36 outputs a number of digital output controls in the form of relay contact closures. In addition, the controller 36 is shown connected to an ABS controller 135 in FIG. 14 which, in turn, actuates control valves 137 on the trailer to control the brake chambers 136. The controller 36 also accepts analog and digital input signal relating to the ABS subsystem.

As stated previously, the connector 37 and respective controllers 35, 36 would similarly apply to agricultural applications. To further illustrate those electronic subsystems which may be readily incorporated into agricultural embodiments of the present invention, TABLE 2 below gives a partial listing of such subsystems and features which may be controlled and/or monitored by respective controllers 35, 36 carried by the farm tractor and implement.

TABLE 2

| TRACTOR | IMPLEMENT |
|---|---|
| ♦ Vehicle Speed Optimization<br>♦ Engine Speed Optimization<br>♦ Implement Display<br>♦ GPS (satellite control) to Implement | ♦ Sprayer Pressure<br>♦ Seed Planting Rates<br>♦ Depth Position<br>♦ Hydraulic Controls<br>♦ Seed Counting<br>♦ Moisture Sensing |

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A vehicle comprising:

a tractor and a trailer connected thereto;

a plurality of electrical conductors extending between said tractor and said trailer;

a connector electrically connected in series with said plurality of electrical conductors, said connector including disengageable first and second connector portions to facilitate disconnecting said tractor and said trailer, a plurality of electrically conducting pins carried by said first connector portion, and mating electrically conductive contacts carried by said second connector portion;

first and second controllers carried by said tractor and said trailer respectively; and a communications channel interconnecting said first and second controllers, said communications channel comprising inductive coupling means carried by said connector for inductively coupling thereacross, said inductive coupling means comprising first and second portions inductively coupled together and respectively carried by said disengageable first and second connector portions of said connector.

2. A vehicle according to claim 1 wherein said first and second portions of said inductive coupling means comprise respective first and second coils.

3. A vehicle according to claim 2 wherein said connector has a generally cylindrical shape, and wherein said first and second coils are positioned on respective first and second disengageable connector portions so as to be coaxially oriented.

4. A vehicle according to claim 1 wherein said trailer includes first signal generating means for generating a first signal relating to operation of the vehicle, and wherein said second controller includes modulation means cooperating with said signal generating means for modulating the generated signal for transmission across said first and second inductive coupling portions.

5. A vehicle according to claim 4 wherein said first controller includes demodulation means connected to said second inductive coupling means for demodulating the signal from said modulation means.

6. A vehicle according to claim 5 wherein said modulation means includes means for frequency shift keying modulation, and wherein said demodulation means includes means for frequency shift keying demodulation.

7. A vehicle according to claim 5 further comprising display means positioned within said tractor and cooperating with said first controller for displaying information related to the first signal; and recording means positioned within said tractor and cooperating with said first controller for recording information related to the first signal.

8. A vehicle according to claim 4 wherein said first signal generating means includes means for generating a signal relating to at least one of a trailer temperature, a trailer location transponder, a trailer smoke detector status, a trailer tire pressure, a trailer brake temperature, a trailer axle temperature, and a trailer light status.

9. A vehicle according to claim 4 wherein said trailer further comprises second signal generating means for generating a second signal related to the operation of the vehicle; and wherein said second controller further comprises multiplexor means, connected to the first and second signal generating means, for multiplexing the first and second signals.

10. A vehicle according to claim 9 wherein said first controller includes demultiplexing means for demultiplexing the first and second signals.

11. A vehicle according to claim 1 wherein said communications channel further comprises first and second sections of twisted pair cable extending between respective controllers and inductive coupling means.

12. A vehicle comprising:

a tractor and a trailer connected thereto;

a plurality of electrical conductors extending between said tractor and said trailer;

a connector electrically connected in series with said plurality of electrical conductors, said connector including disengageable first and second connector portions to facilitate disconnecting said tractor and said trailer, a plurality of electrically conducting pins carried by said first connector portion, and mating electrically conductive contacts carried by said second connector portion;

first and second controllers carried by said tractor and said trailer respectively, said controllers comprising respective modulator/demodulator means for establishing a bidirectional communications link therebetween; and a communications channel interconnecting said first and second controllers, said communications channel comprising inductive coupling means carried by said connector for inductively coupling thereacross, said inductive coupling means comprising first and second portions inductively coupled together and respectively carried by said disengageable first and second connector portions of said connector.

13. A vehicle according to claim 12 wherein said modulation means includes means for frequency shift keying modulation, and wherein said demodulation means includes means for frequency shift keying demodulation.

14. A vehicle according to claim 12 wherein said first and second portions of said inductive coupling means comprise respective first and second coils.

15. A vehicle according to claim 14 wherein said connector has a generally cylindrical shape, and wherein said first and second coils are positioned on respective first and second disengageable connector portions so as to be coaxially oriented.

16. A vehicle according to claim 12 wherein said trailer includes a plurality of signal generating means for generating a plurality of signals relating to operation of the vehicle, and wherein said second controller includes multiplexor means connected to said plurality of signal generating means and cooperating with said modulator/demodulator means for multiplexing said plurality of signals for transmission to said first controller.

17. A vehicle according to claim 16 wherein said first controller includes demultiplexing means for demultiplexing the plurality of signals.

18. A vehicle according to claim 17 further comprising display means positioned within said tractor and cooperating with said first controller for displaying information related to the plurality of signals; and recording means positioned within said tractor and cooperating with said first controller for recording information related to the plurality of signals.

19. A vehicle according to claim 16 wherein said plurality of signal generating means includes means for generating a signal relating to at least one of a trailer temperature, a trailer location transponder, a trailer smoke detector status, a trailer tire pressure, a trailer brake temperature, a trailer axle temperature, and a trailer light status.

20. A vehicle according to claim 12 wherein said communications channel further comprises first and second sections of twisted pair cable extending between respective controllers and inductive coupling means.

21. A tractor adapted to be connected to a trailer for pulling the trailer, said tractor comprising:

a frame;

motor means carried by said frame for moving the tractor;

coupling means, carried by said frame, for coupling to a trailer;

a plurality of electrical conductors carried by said frame;

a connector portion electrically connected to said plurality of electrical conductors and including a plurality of electrically conducting pins, said connector portion being adapted to connect to a mating connector portion having electrically conductive contacts and being carried by the trailer;

an inductive coupler carried by said connector portion and adapted for inductively coupling across a connection to the trailer; and a controller carried by said frame and connected to said inductive coupler.

22. A tractor according to claim 21 wherein said inductive coupler comprise a coil.

23. A tractor according to claim 22 wherein said connector portion has a generally cylindrical shape, and wherein said coil is wound coaxially with said connector portion.

24. A tractor according to claim 21 wherein said controller includes demodulation means connected to said inductive coupler and adapted for demodulating a signal therefrom.

25. A tractor according to claim 24 wherein said demodulation means includes means of frequency shift keying demodulation.

26. A tractor according to claim 24 wherein said controller includes demultiplexing means adapted for demultiplexing a plurality of signals from the demodulation means.

27. A tractor according to claim 26 further comprising display means carried by said frame and cooperating with said controller for displaying information related to the demultiplexed signals.

28. A tractor according to claim 21 wherein said controller further comprises digital interface means adapted for interfacing with at least one of a digital input signal relating to operation of the tractor, and a digital output signal for operation of the tractor.

29. A tractor according to claim 21 wherein said controller further comprises analog interface means adapted for interfacing with at least one of an analog input signal relating to operation of the tractor, and an analog output signal for operation of the tractor.

30. A tractor according to claim 21 wherein said controller further comprises data bus interface means adapted for communicating with a plurality of data transceivers carried by said frame.

31. A tractor according to claim 21 wherein said controller further comprises memory means adapted for storing and retrieving data related to operation of at least one of the tractor and a trailer connected thereto.

32. A tractor according to claim 21 further comprising a section of twisted pair cable extending between said controller and said inductive coupler.

33. A tractor according to claim 21 further comprising an external controller inductively coupled to said inductive coupler carried by said connector portion.

34. A tractor according to claim 33 wherein said external controller includes processor means for storing and retrieving data from said controller of said tractor.

35. A trailer adapted to be connected to a tractor to be pulled by the tractor, said trailer comprising:

a frame;

coupling means, carried by said frame, for coupling to a tractor;

a plurality of electrical conductors carried by said frame;

a connector portion electrically connected to said plurality of electrical conductors and including electrically conductive contacts, said connector portion being adapted to connect to a mating connector portion having a plurality of electrically conducting pins being carried by the tractor;

an inductive coupler carried by said connector portion and adapted for inductively coupling across a connection to the trailer; and a controller carried by said frame and connected to said inductive coupler.

36. A trailer according to claim 35 wherein said inductive coupler comprises a coil.

37. A trailer according to claim 36 wherein said connector portion has a cylindrical shape, and wherein said coil is wound coaxially with said connector portion.

38. A trailer according to claim 35 further comprising signal generating means carried by said frame for generating a plurality of signals relating to operation of the trailer, and wherein said controller includes modulation means cooperating with said signal generating means for modulating the signals for transmission across said inductive coupler.

39. A trailer according to claim 38 wherein said modulation means includes means for frequency shift keying modulation.

40. A trailer according to claim 38 wherein said controller further includes multiplexing means for multiplexing a plurality of signals from the signal generating means.

41. A trailer according to claim 35 wherein said controller further comprises digital interface means adapted for interfacing with at least one of a digital input signal relating to operation of the trailer, and a digital output signal for operation of the trailer.

42. A trailer according to claim 35 wherein said controller further comprises analog interface means adapted for interfacing with at least one of an analog input signal relating to operation of the trailer, and an analog output signal for operation of the trailer.

43. A trailer according to claim 35 wherein said controller further comprises data bus interface means adapted for communicating with a plurality of data transceivers carried by said frame.

44. A trailer according to claim 35 wherein said controller further comprises memory means adapted for storing and retrieving data related to operation of at least one of the trailer and a tractor connected thereto.

45. A trailer according to claim 35 further comprising a section of twisted pair cable extending between said controller and said inductive coupler.

46. A trailer according to claim 35 further comprising an external controller inductively coupled to said inductive coupler carried by said connector portion.

47. A trailer according to claim 46 wherein said external controller includes processor means for storing and retrieving data from the controller of said trailer.

48. A combination of an external controller and at least one trailer connected thereto, said combination comprising:

a plurality of electrical conductors extending between said external controller and said at least one trailer;

a connector electrically connected in series with said plurality of electrical conductors, said connector including disengageable first and second connector portions to facilitate disconnecting said external controller and said at least one trailer, a plurality of electrically conducting pins carried by said first connector portion, and mating electrically conductive contacts carried by said second connector portion;

a trailer controller carried by said at least one trailer; and a communications channel interconnecting said external and trailer controllers, said communications channel comprising inductive coupling means carried by said connector for inductively coupling thereacross, said inductive coupling means comprising first and second portions inductively coupled together and carried by respective disengageable first and second connector portions.

49. A combination according to claim 48 wherein said first and second portions of said inductive coupling means comprise respective first and second coils.

50. A combination according to claim 49 wherein said connector has a generally cylindrical shape, and wherein said first and second coils are positioned on respective first and second disengageable connector portions so as to be coaxially oriented.

51. A combination according to claim 48 wherein said at least one trailer includes first signal generating means for generating a first signal relating to operation of the trailer, and wherein said trailer controller includes modulation means cooperating with said signal generating means for modulating the generated signal for transmission across said first and second inductive coupling portions.

52. A combination according to claim 51 wherein said external controller includes demodulation means connected to said second inductive coupling means for demodulating the signal from said modulation means.

53. A combination according to claim 52 further comprising display means electrically connected to said external controller and cooperating with said trailer controller for displaying information related to the first signal; and recording means electrically connected to said external controller and cooperating with said trailer controller for recording information related to the first signal.

54. A combination according to claim 52 wherein said modulation means includes means for frequency shift keying modulation, and wherein said demodulation means includes means for frequency shift keying demodulation.

55. A method for communicating between first and second controllers carried by a tractor and a trailer, respectively, the tractor and trailer being of the type including a plurality of electrical conductors extending therebetween and a connector electrically connected in series with the plurality of electrical conductors, the connector including disengageable first and second connector portions to facilitate disconnecting the tractor and trailer, a plurality of electrically conducting pins carried by the first connector portion, and mating electrically conductive contacts carried by the second connector portion said method comprising the steps of:

positioning first and second coils on the respective first and second connector portions so that the first and second coils are arranged inductively coupled relation;

connecting the respective first and second coils to the first and second controllers respectively; and transmitting a signal from the first controller to the second controller via inductive coupling between the first and second coils.

56. A method according to claim 55 wherein the first and second connector portions are generally cylindrical, and wherein the step of positioning the first and second coils comprises positioning same on the first and second connector portions so as to be coaxially oriented relative to one another.

57. A method according to claim 55 wherein the step of connecting the first and second controllers to the first and second coils comprises connecting same via a twisted pair cable.

58. A method according to claim 55 wherein the step of transmitting comprises modulating a signal at the first controller and demodulating the modulated signal at the second controller.

59. A method according to claim 58 wherein the step of modulating comprises modulating a signal using frequency shift keying modulation at the first controller and wherein the step of demodulating comprises the step of demodulating the modulated signal using frequency shift keying demodulation at the second controller.

60. A method according to claim 58 wherein the step of modulating comprises modulating a signal using spread spectrum modulation at the first controller and wherein the step of demodulating comprises the step of demodulating the modulated signal using spread spectrum demodulation at the second controller.

* * * * *